US010228643B2

(12) United States Patent
Nakamoto

(10) Patent No.: US 10,228,643 B2
(45) Date of Patent: Mar. 12, 2019

(54) IMAGE HEATING APPARATUS HAVING A SHEET-LIKE MEMBER THAT COVERS A SURFACE OF A STATIONARY PAD AND A SURFACE OF A MOVABLE PAD MEMBER THAT ARE EACH OPPOSITE TO A ROTATABLE MEMBER

(71) Applicant: CANON KABUSHIKI KAISHA, Tokyo (JP)

(72) Inventor: Ikuo Nakamoto, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/658,728

(22) Filed: Jul. 25, 2017

(65) Prior Publication Data

US 2018/0032010 A1 Feb. 1, 2018

(30) Foreign Application Priority Data

Jul. 26, 2016 (JP) ..... 2016-146143

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/329
See application file for complete search history.

(56) References Cited

U.S. PATENT DOCUMENTS

| | | | | |
|---|---|---|---|---|
| 7,200,354 | B2 | 4/2007 | Nakamoto et al. | |
| 7,406,288 | B2 | 7/2008 | Nakamoto et al. | |
| 7,457,576 | B2 | 11/2008 | Takada et al. | |
| 7,542,711 | B2 | 6/2009 | Nakamoto et al. | |
| 7,596,348 | B2 | 9/2009 | Nakamoto et al. | |
| 7,792,477 | B2 | 9/2010 | Nakamoto et al. | |
| 7,844,208 | B2 | 11/2010 | Hayashi et al. | |
| 2008/0205924 | A1* | 8/2008 | Fujimoto | G03G 15/50 399/70 |
| 2011/0135358 | A1* | 6/2011 | Kikuchi | G03G 15/2064 399/329 |

FOREIGN PATENT DOCUMENTS

JP 2002-221866 A 8/2002

* cited by examiner

*Primary Examiner* — Quana M Grainger
(74) *Attorney, Agent, or Firm* — Venable LLP

(57) ABSTRACT

An image heating apparatus includes an endless belt and a rotatable member configured to form a nip for heating a toner image on a recording material therebetween, a substantially stationary pad member and a movable pad member provided along a feeding direction of the recording material and configured to press the endless belt toward the rotatable member from an inside of the endless belt, a moving mechanism configured to move the movable pad member between a first position at which the movable pad member presses the endless belt toward the rotatable member and a second position at which the movable pad member does not press the endless belt toward the rotatable member, and a sheet-like member configured to cover such a surface of the stationary pad member as is opposite to the rotatable member and such a surface of the movable pad member as is opposite to the rotatable member.

17 Claims, 17 Drawing Sheets

(a)

(b)

IMAGE HEATING APPARATUS HAVING A SHEET-LIKE MEMBER THAT COVERS A SURFACE OF A STATIONARY PAD AND A SURFACE OF A MOVABLE PAD MEMBER THAT ARE EACH OPPOSITE TO A ROTATABLE MEMBER

CLAIM TO PRIORITY

This application claims the benefit of Japanese Patent Application No. 2016-146143 filed on Jul. 26, 2016, which is hereby incorporated by reference herein in its entirety.

BACKGROUND OF THE INVENTION

Field of the Invention

The present invention relates to an image heating apparatus for heating a toner image on a recording medium. This type of image heating apparatus is employed by a copying machine, a printing machine, a facsimile machine, or a multifunction image forming apparatus capable of functioning as two or more of the preceding machines, for example.

A conventional electrophotographic image forming apparatus is provided with a fixing apparatus (image heating apparatus) for fixing a toner image formed on a recording medium (a sheet of recording paper, or the like), to the recording medium with the use of heat and pressure.

The conditions under which a toner image on a sheet of recording paper (recording medium) can be optimally fixed to the sheet is affected by the basis weight of the sheet. Thus, this type of fixing apparatus (image heating apparatus) has been variously devised. For example, in the case of one of these types of fixing apparatus, it is designed so that it can be changed in fixation temperature according to the basis weight of the sheet.

In recent years, the types of recording media have substantially increased in choice. Further, it has been increasingly desired to form an image on an extremely thin sheet of recording paper. From the standpoint of ensuring that an extremely thin sheet of paper is satisfactorily conveyed through a fixing apparatus, it is desired that the fixing apparatus be improved in sheet separation, and also, that it is configured so that it can be optimized in the amount by which heat is applied to the sheet of recording paper.

That is, if a fixing apparatus cannot be adjusted in fixation condition, it cannot properly fix a toner image on every sheet of various types of recording paper. Thus, the fixing apparatus disclosed in Japanese Laid-open Patent Application No. 2002-221866 is configured so that it can be changed in nip width according to the basis weight of recording medium.

Thus, the inventors of the present invention came up with a fixing apparatus enabled to form a minimum of two nips that are different in width, with the use of two pads (pad-like members), in order to properly fix a toner image.

SUMMARY OF THE INVENTION

According to one aspect, the present invention provides an image heating apparatus comprising a pair of rotatable members, at least one of which is an endless belt, the rotatable members being configured to form a nip for heating a toner image on a recording material, a first pad member and a second pad member provided along a feeding direction of the recording material and configured to urge the at least one of the endless belts toward the other one of the rotatable members from an inside of the at least one of the endless belts, a moving mechanism configured to move the second pad member to selectively contact both of the first pad member and the second pad member to the endless belt, or contact only the first pad member to the endless belt, and a single sheet-like member slidable relative to an inner surface of the endless belt.

Further features of the present invention will become apparent from the following description of exemplary embodiments with reference to the attached drawings.

Figure 7:
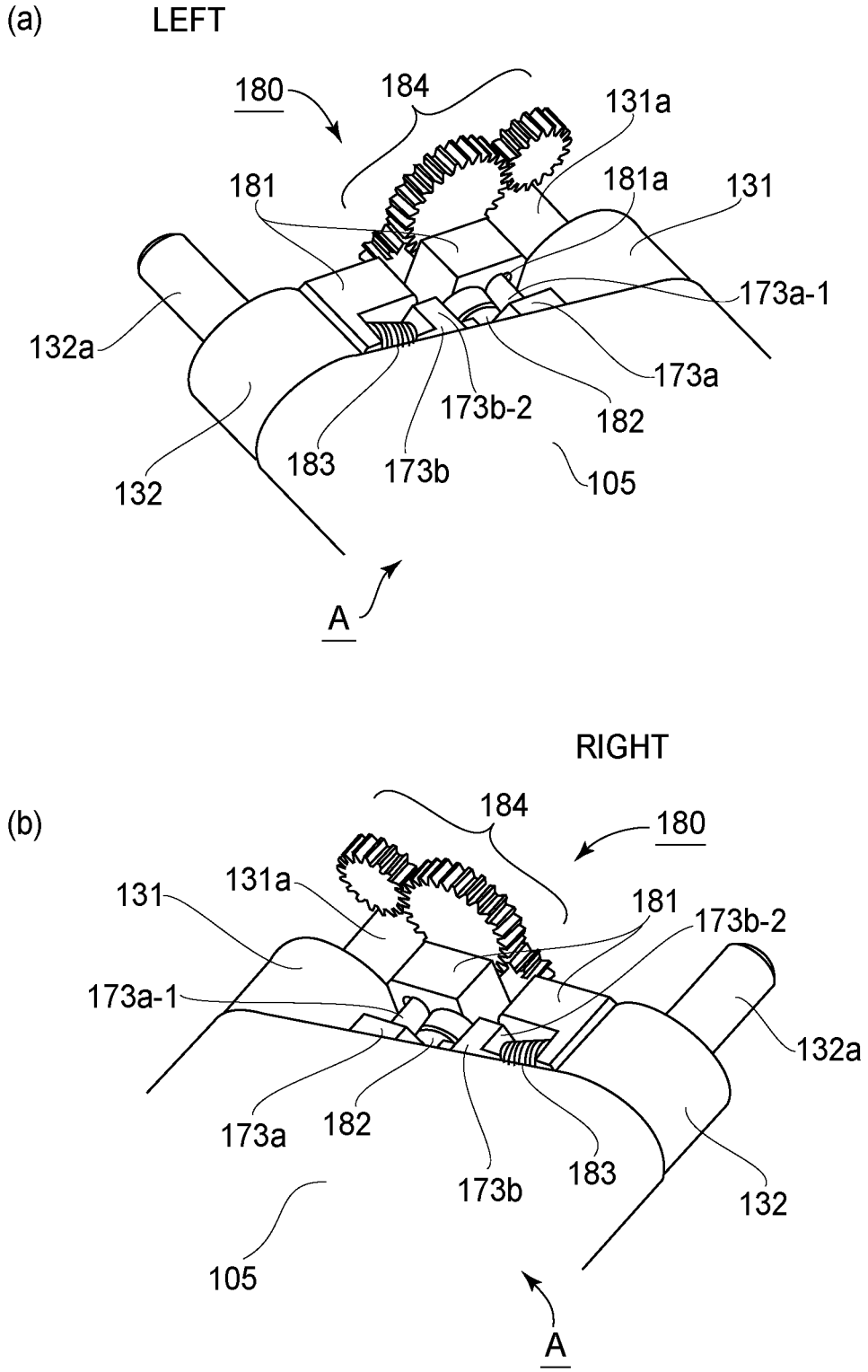

Parts (a) and (b) of FIG. 7 are perspective views of the left and right pad moving mechanisms of the top belt assembly, respectively.

Figure 8:
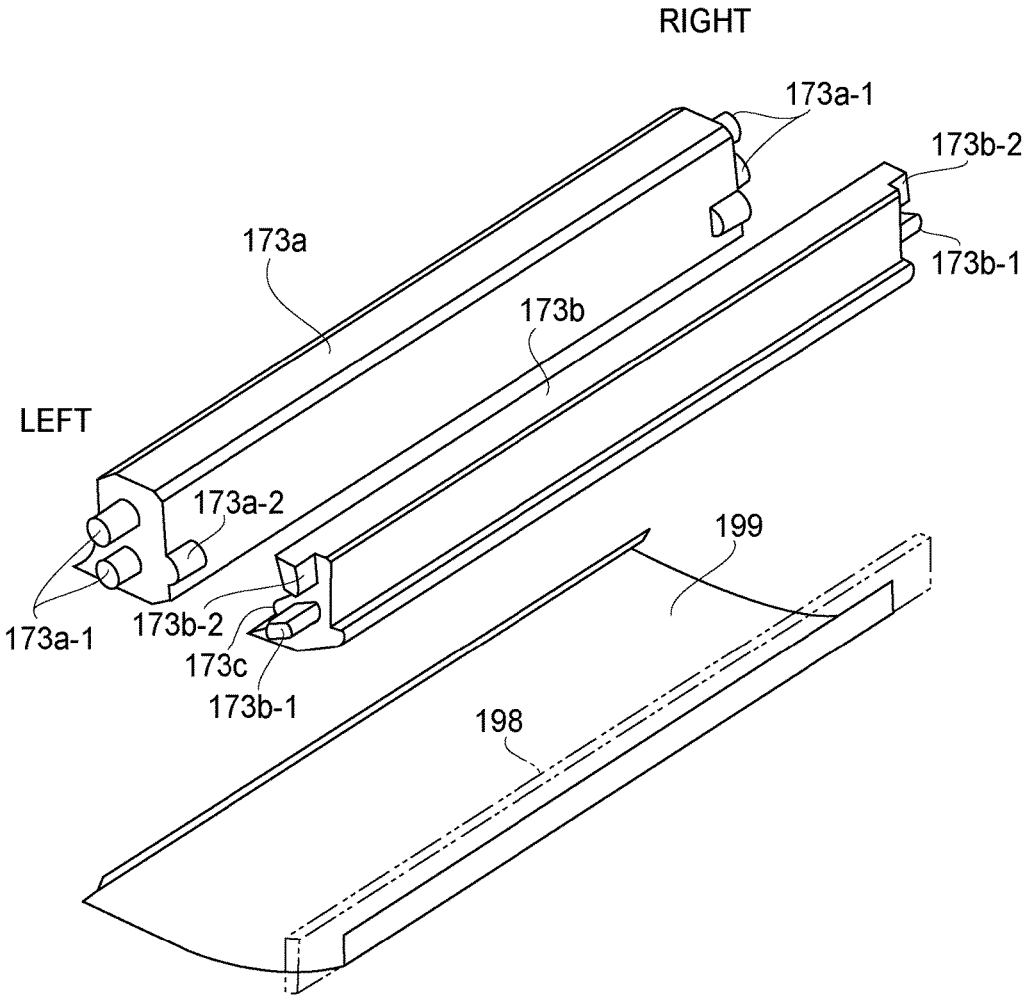

FIG. 8 is an exploded perspective view of the fixation pad assembly made up of the fixation pad, the movable pad, and the friction reduction sheet.

Figure 9:
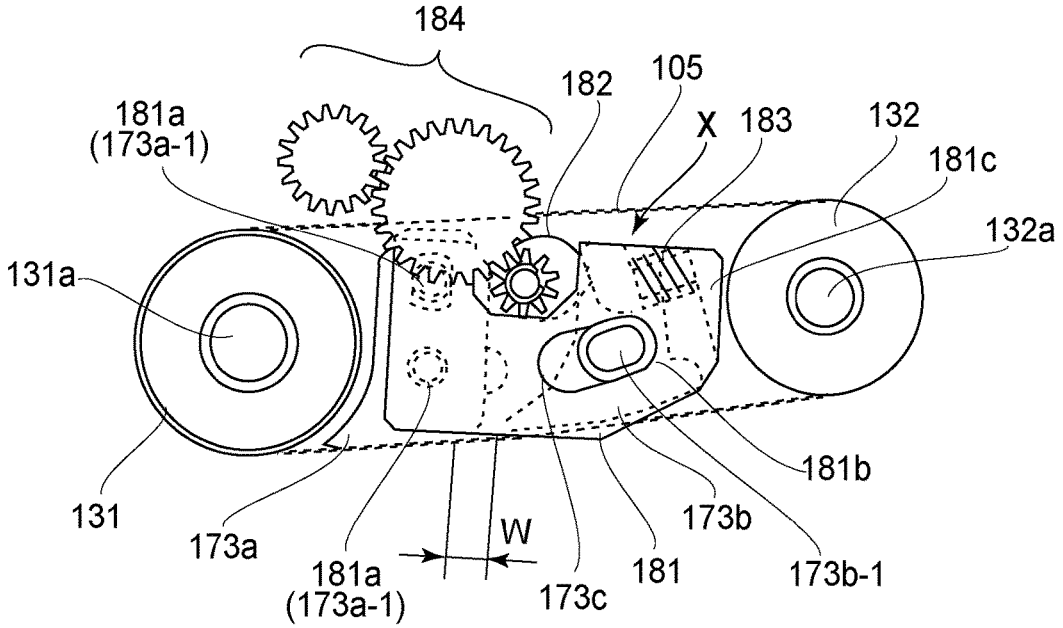

FIG. 9 is a partially phantom sectional view of the pad moving mechanism. This shows the operation of the mechanism (1).

Figure 10:
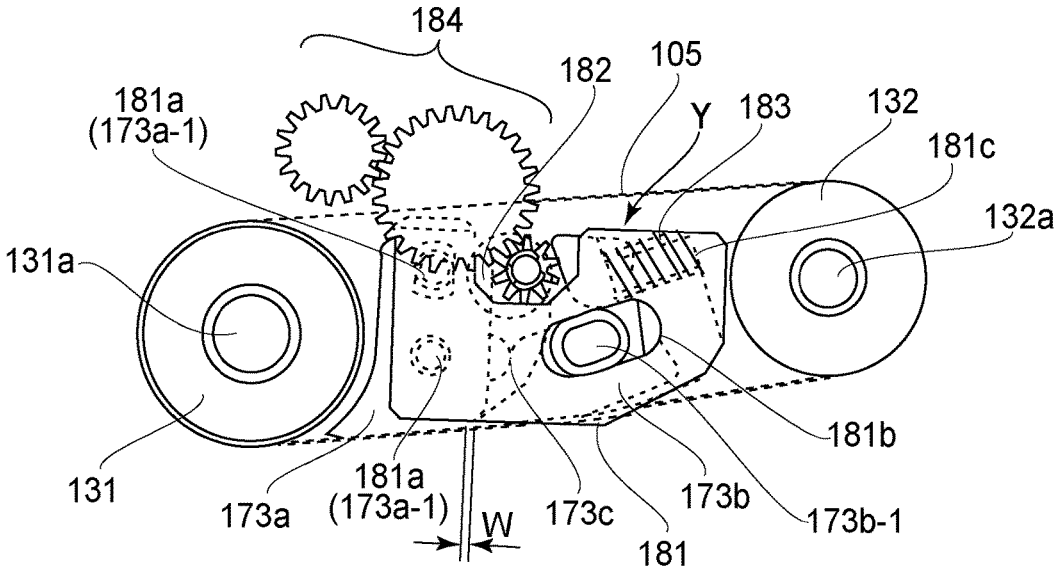

FIG. 10 is a partially phantom sectional view of the pad moving mechanism. This shows the operation of the mechanism (2).

Figure 11:
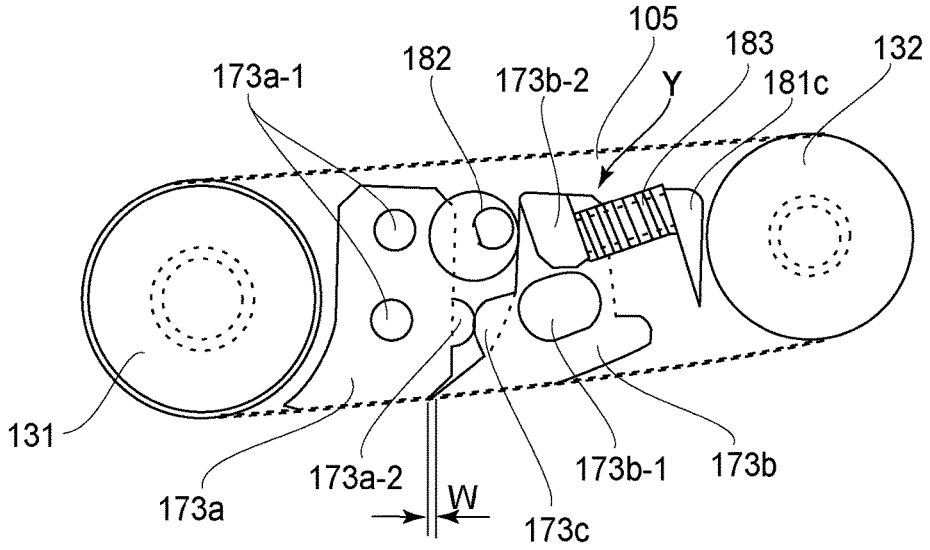

FIG. 11 is a partially phantom sectional view of the pad moving mechanism. This shows the operation of the mechanism (3).

Figure 12:
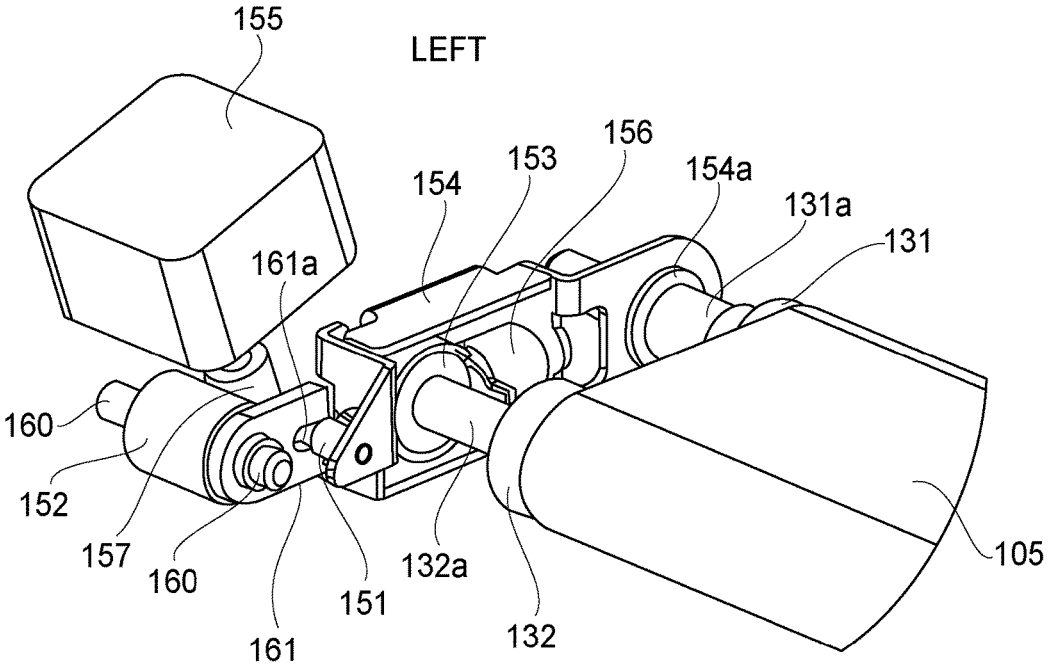

FIG. 12 is a perspective view of the belt deviation controlling portion of the top belt assembly.

Figure 13:
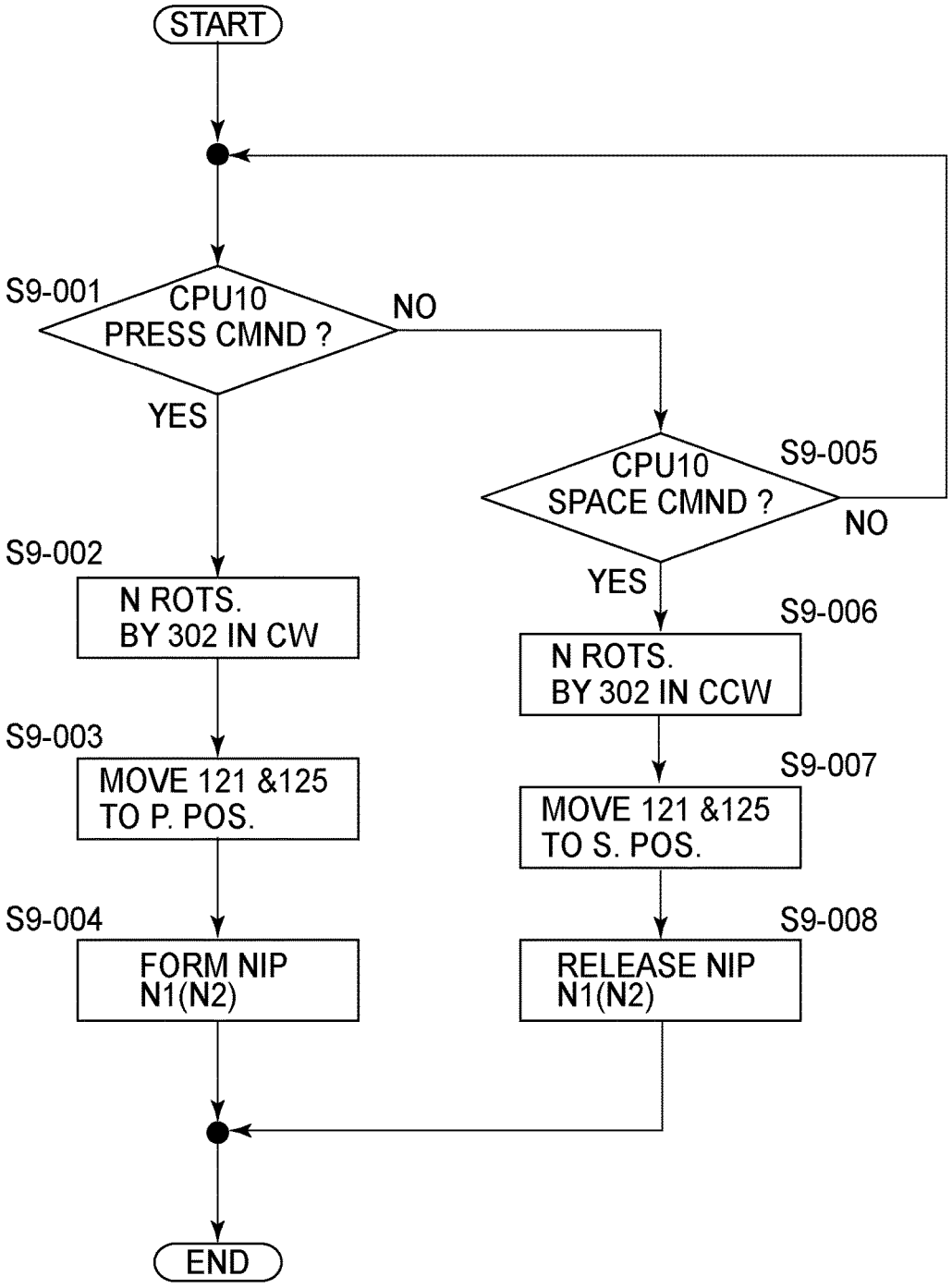

FIG. 13 is a flowchart of the control sequence for placing the bottom belt assembly in contact with the top belt assembly, or separating the bottom belt assembly from the top belt assembly.

Figure 14:
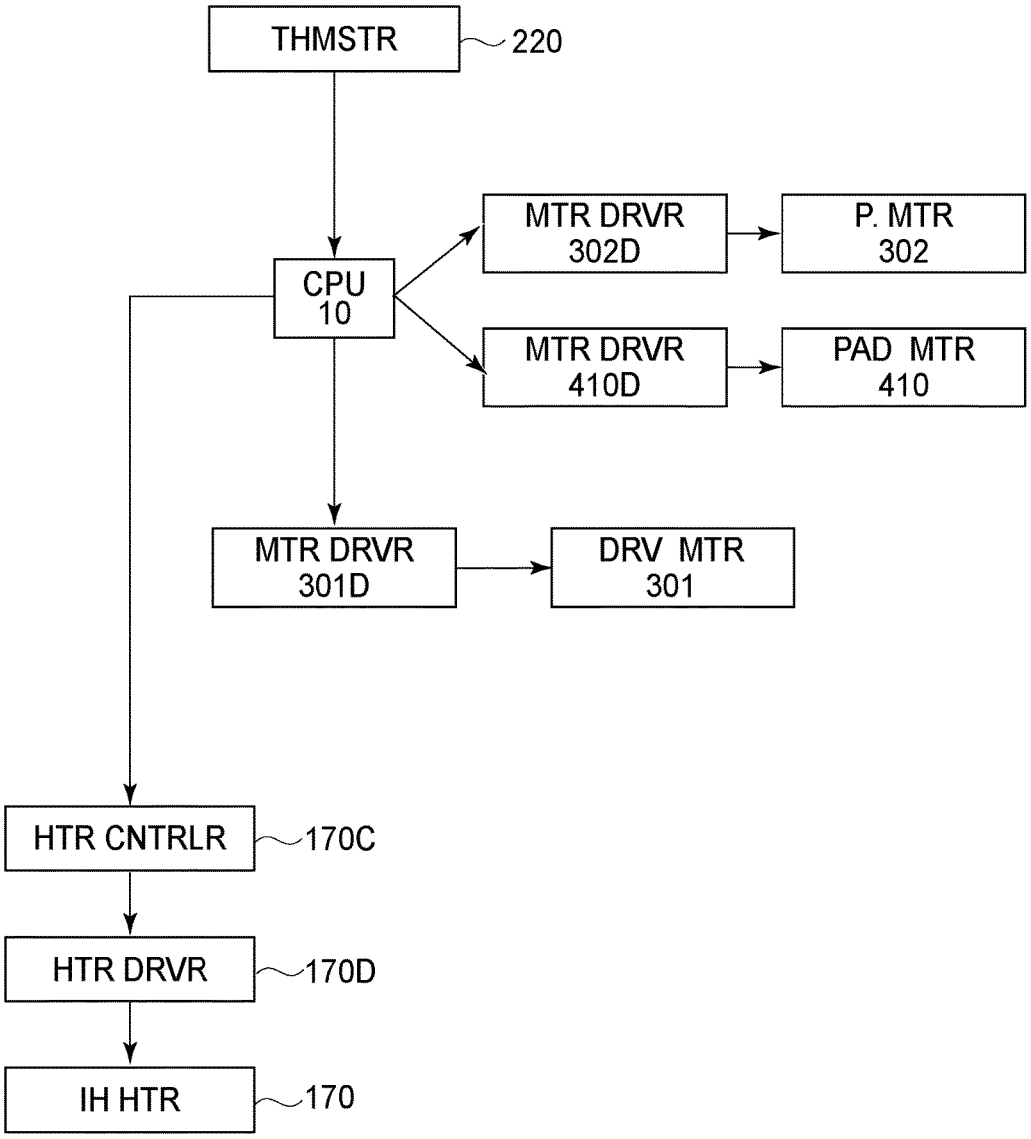

FIG. 14 is a block diagram of the control system.

Figure 15:
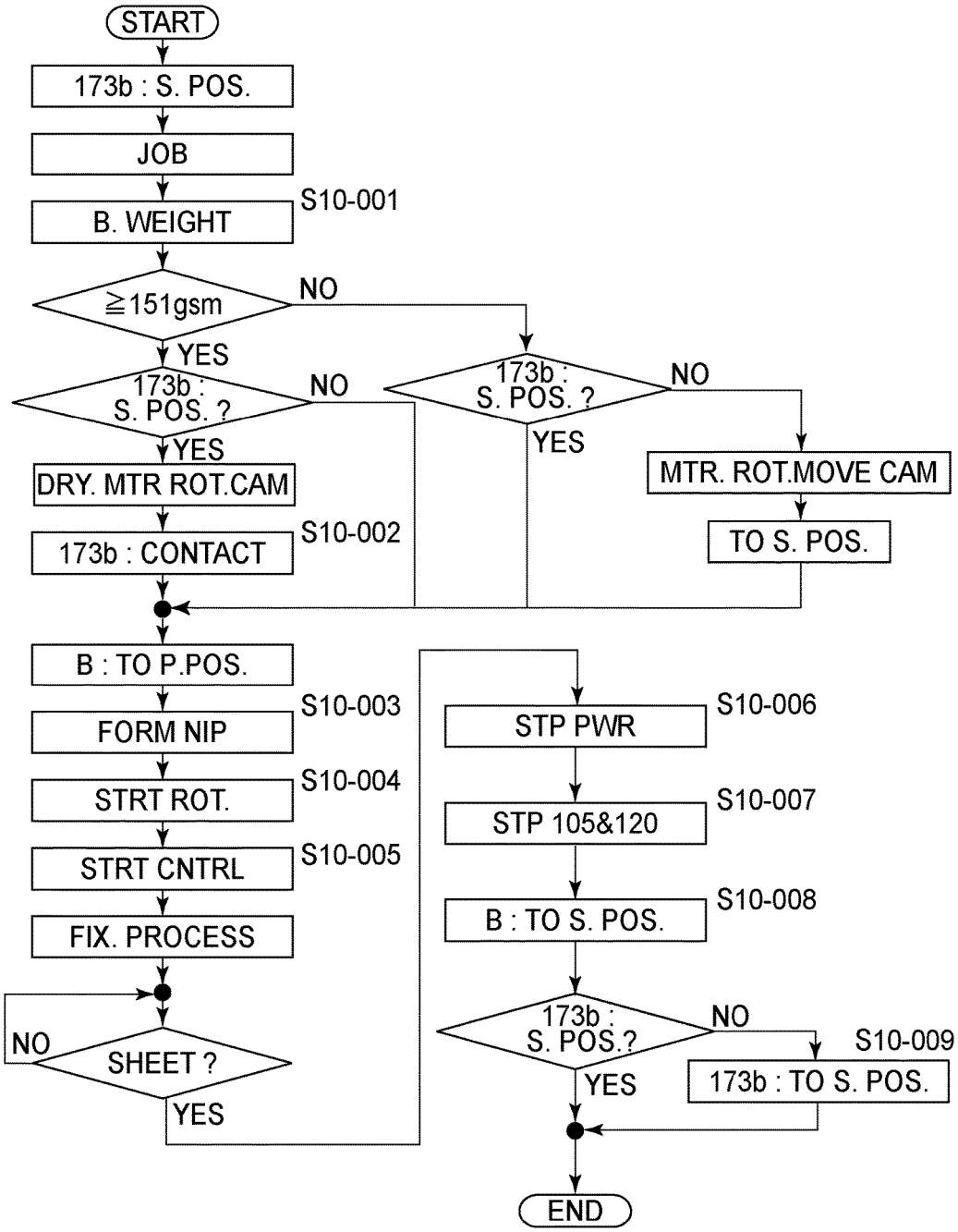

FIG. 15 is a flowchart of the image fixing process.

Figure 16:
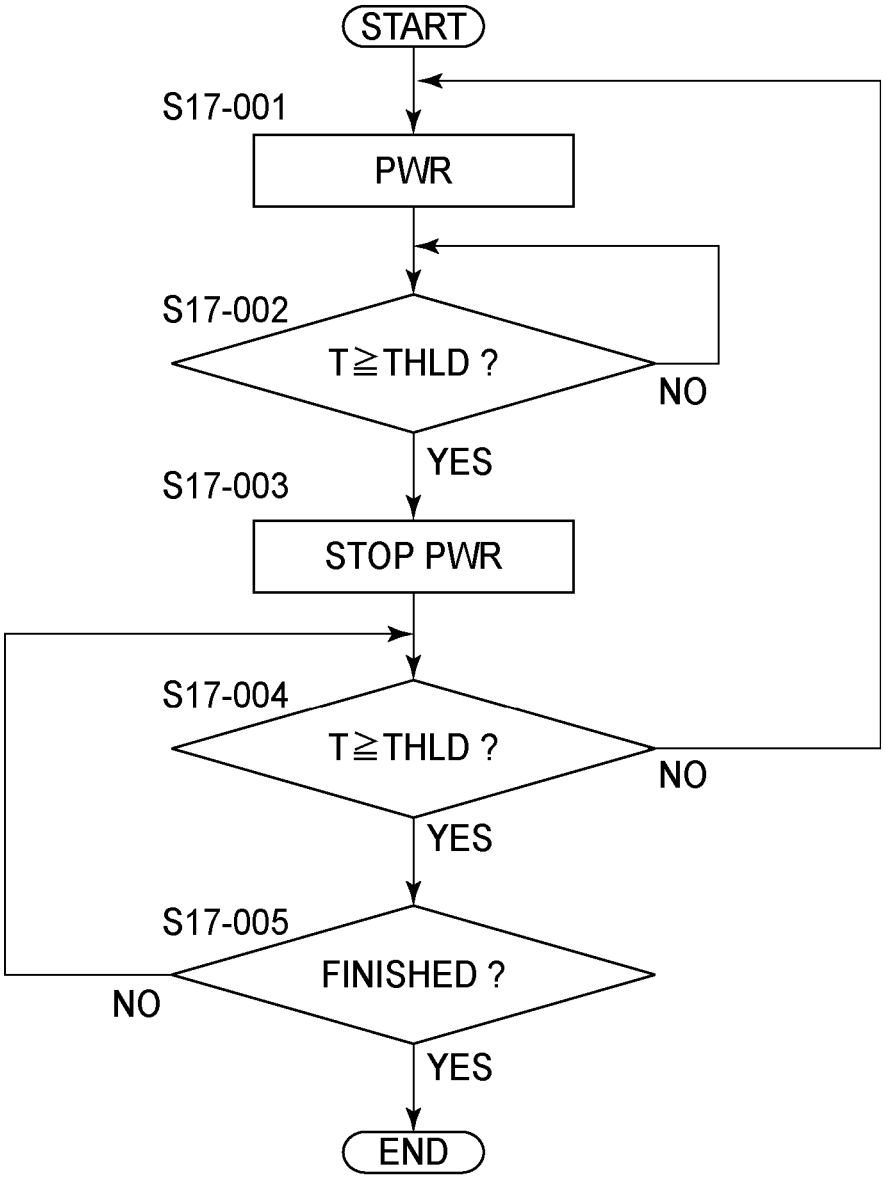

FIG. 16 is a flowchart of the temperature controlling process.

Figure 17:
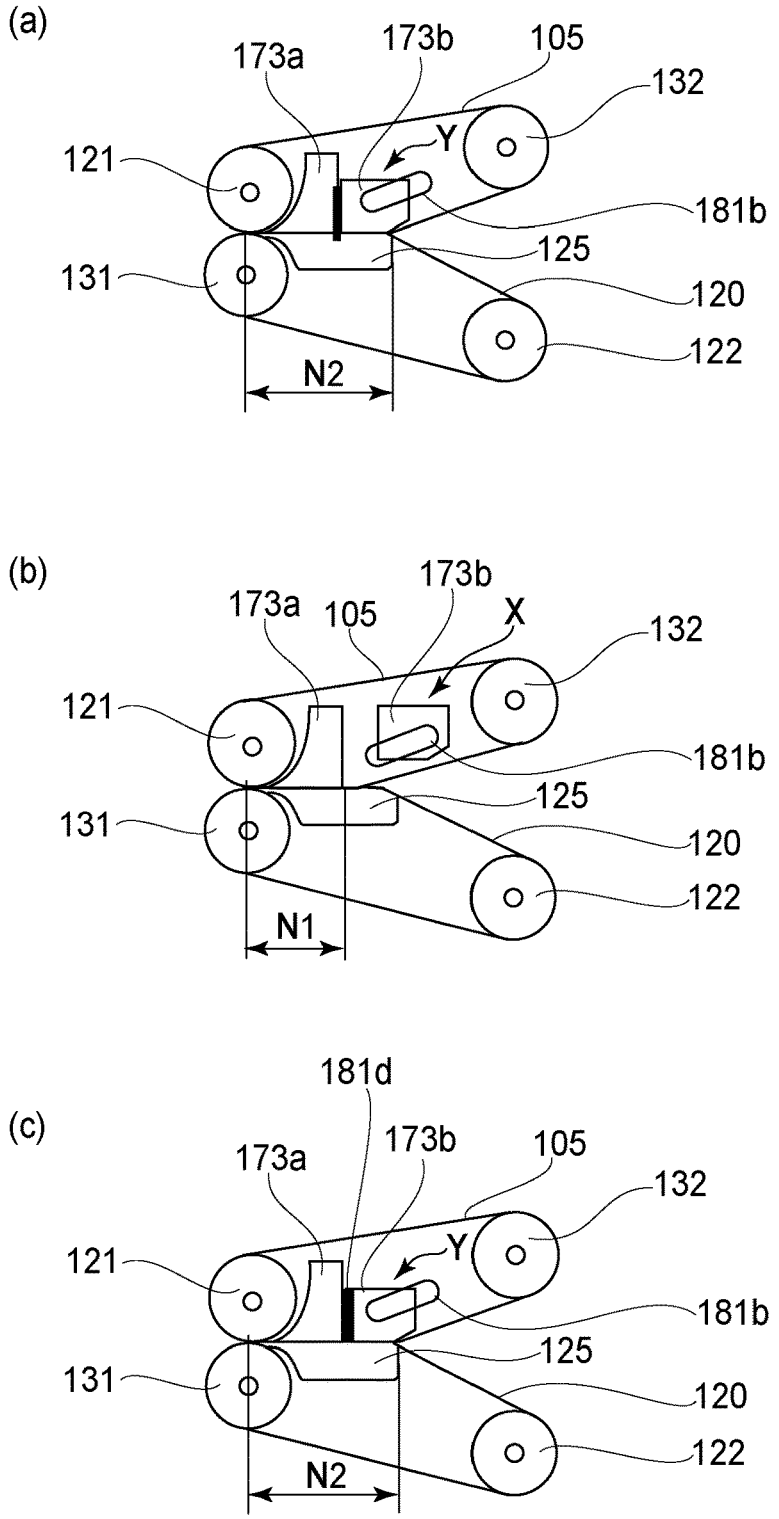

Parts (a), (b), and (c) of FIG. 17 are schematic views of the fixing apparatus in one of the modified versions of the first embodiment (1).

Figure 18:
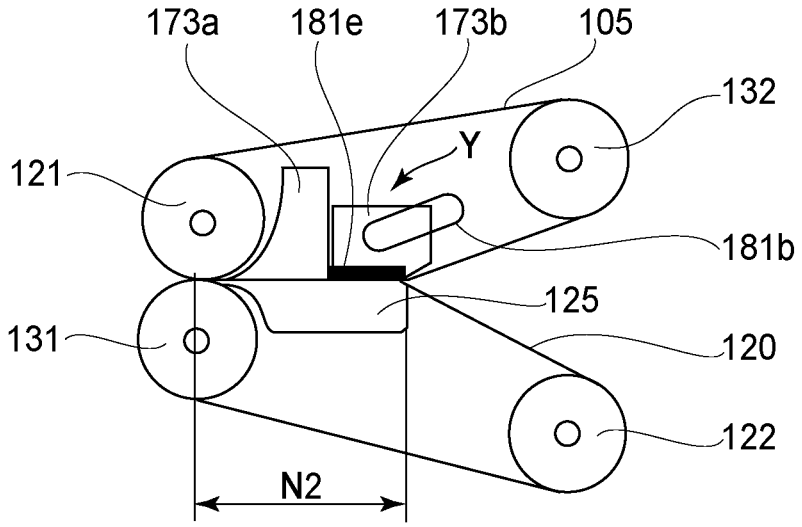
Figure 18:
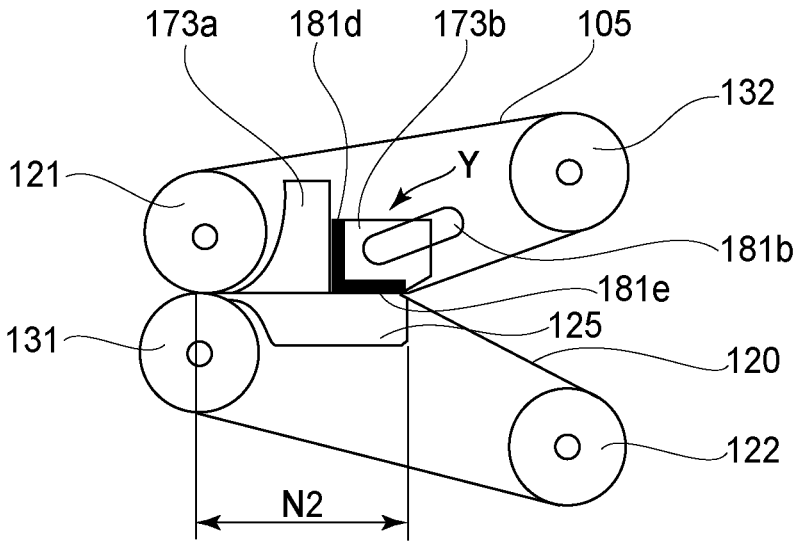

Parts (a) and (b) of FIG. 18 are schematic views of the fixing apparatus in another of the modified version of the first embodiment (2).

Figure 19:
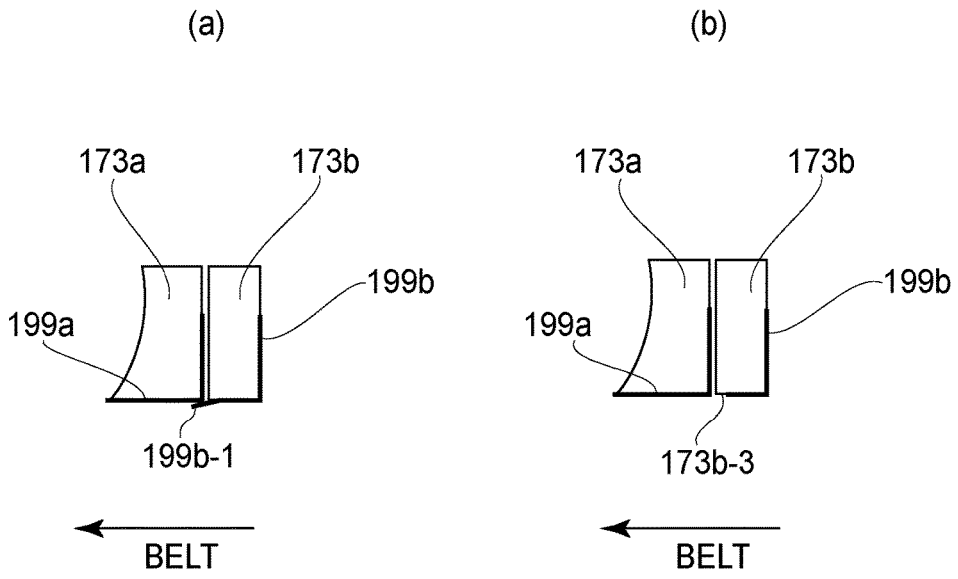

Parts (a) and (b) of FIG. 19 are schematic views illustrating the positioning of the friction reduction sheet relative to the movable pad.

DESCRIPTION OF THE EMBODIMENTS

Hereafter, referring to the appended drawings, the present invention is described in detail with reference to one of the preferred embodiments of the present invention.

Embodiment 1

(Image Forming Apparatus)

Figure 2:
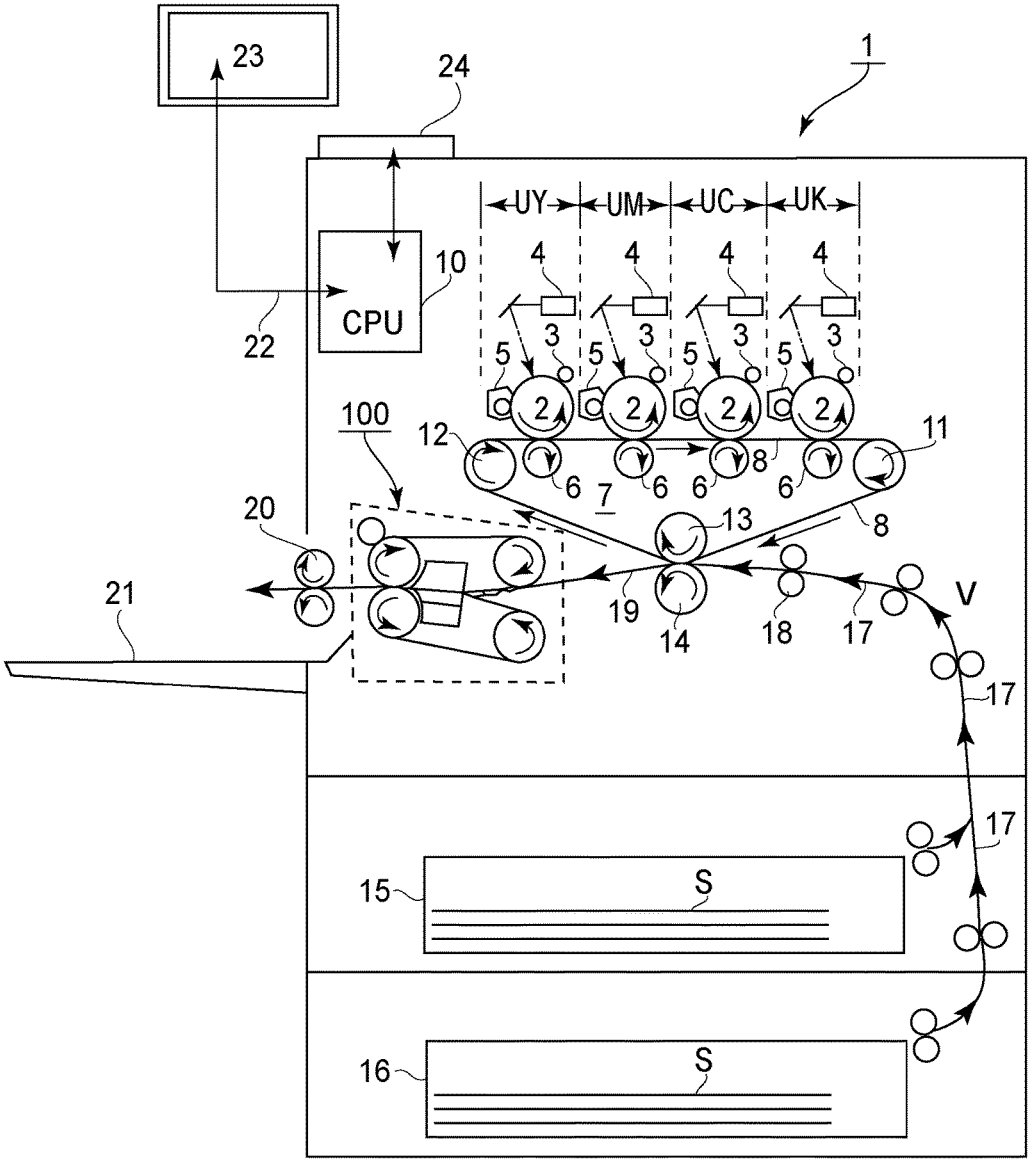
FIG. 2 is a schematic sectional view of the image forming apparatus in the image forming apparatus in the first embodiment, which shows the general structure of the apparatus.

FIG. 2 is a schematic sectional view of the image forming apparatus 1 in this embodiment, at a plane that is parallel to the direction V in which a sheet S (which hereafter may be referred to as a sheet of recording medium or a sheet of recording paper) is conveyed in the image forming apparatus 1. This image forming apparatus 1 is an electrophotographic full-color printer (which hereafter may be referred to simply as a "printer"). This printer 1 can form an image on a sheet S of recording paper, according to the image data (electrical information of image to be formed) inputted thereto from an external host apparatus 23, which is in connection to the printer control portion (which hereafter will be referred to simply as a "CPU") through an interface 22, and can output the sheet S as a print.

The CPU 10 is a controlling portion (executing portion), which integrally controls various operations of the image forming apparatus 1. It exchanges various electrical information signals with the external host apparatus 23, and the control panel of the image forming apparatus 1. Further, it processes the electrical information signals inputted from various processing devices, sensors, and command signals to be outputted to the various processing devices. Moreover, it controls the preset sequence for initializing the apparatus 1, and the preset image formation sequence. The external host apparatus 23 is a personal computer, a network, an image reader, a facsmile machine, and the like.

Figure 1:
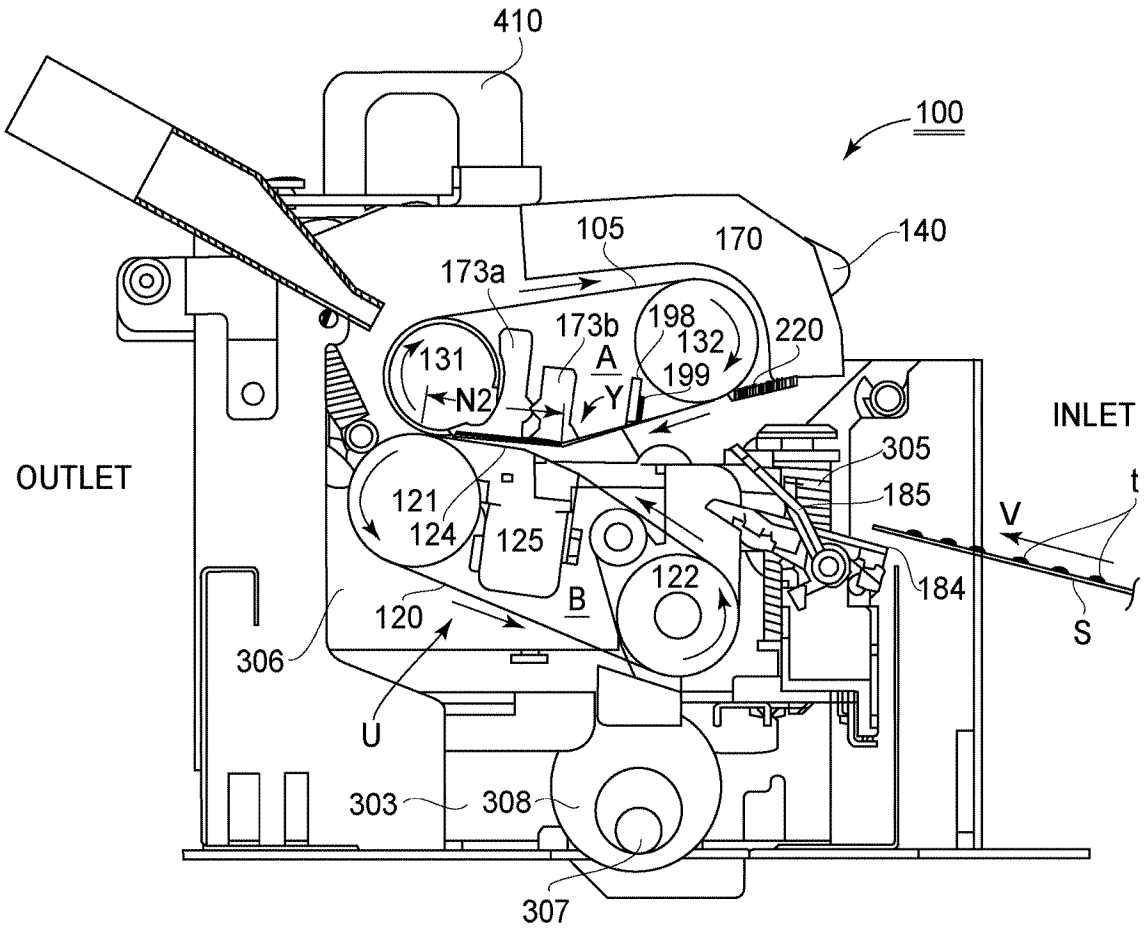
FIG. 1 is a schematic sectional view of the essential portion of the fixing apparatus in the first embodiment of the present invention, as seen from the left side of the apparatus.

The printer 1 is provided with four image forming portions U (first to fourth image forming portions UY, UM, UC, and UK, respectively), which are sequentially disposed in tandem in the left to right direction in FIG. 1) (first to fourth image forming portions). Each of the four image forming portions U is an electrophotographic image formation system. The four image forming portions U are the same in structure. They are different only in the color of the toner, as developer, which they hold in their developing devices 5, the image forming portions UY, UM, UC, and UK holding yellow (Y), magenta (M), cyan (C) and black (K) toners, respectively.

That is, each image forming portion U has an electrophotographic photosensitive member 2 (which hereafter may be referred to as a "drum"), and processing devices, more specifically, a charge roller 3, a laser scanner 4, a developing device 5, a primary transfer roller 6, etc., which act on the drum 2.

The drum 2 in each image forming portion U is rotationally driven at a preset speed in the counterclockwise direction indicated by an arrow mark. On the drum 2 of the first image forming portion UY, a monochromatic yellow (Y) image, which corresponds to the yellow (Y) color component of the full-color image to be formed, is formed. On the drum 2 of the second image forming portion UM, a monochromatic magenta (M) image, which corresponds to the magenta (M) color component of the full-color image to be formed, is formed. On the drum 2 of the third image forming portion UC, a monochromatic cyan (C) image, which corresponds to the cyan (C) color component of the full-color image to be formed, is formed. On the drum 2 of the fourth image forming portion UK, a monochromatic black (K) image, which corresponds to the black (K) color component of the full-color image to be formed, is formed. The process through which a toner image is formed on the drum 2 of each image forming portion U, and the principle based on which a toner image is formed on the drum 2 of each image forming portion U, are well known, and, therefore, are not described here.

On the bottom side of the combination of the four image forming portions U, an intermediary transfer belt unit 7 is disposed. This unit 7 has an intermediary transfer belt 8, as an intermediary transferring member, which is flexible. The belt 8 is suspended and tensioned by a combination of three rollers, more specifically, a driver roller 11, a tension roller 12, and a belt backing roller 13 (which opposes a secondary transfer roller), in such a manner that the belt 8 bridges the adjacent two rollers. As the driver roller 11 is driven, the belt 8 is circularly moved in the clockwise direction indicated by an arrow mark at a speed that corresponds to the peripheral velocity of the drum 2. A secondary transfer roller 14 is kept pressed against the belt-backing roller 13 by a preset amount of pressure, with the presence of the belt 8 between the rollers 13 and 14. The area of contact between the belt 8 and secondary transfer roller 14 is the secondary transfer nip.

The primary transfer roller 6 of each image forming portion U is disposed on the inward side of the loop (belt loop) which the belt 8 forms. Each primary roller 6 is disposed in contact with the portion of the inward surface of the belt 8, which is in contact with the downwardly facing portion of the corresponding drum 2. The area of contact between the drum 2 of each image forming portion U and the belt 8 is the primary transfer nip. To the primary transfer roller 6, a preset primary transfer bias is applied with preset control timing.

As the belt 8 is circularly moved, the yellow (Y), magenta (M), cyan (C), and black (K) toner images formed on the four drums 2 in the four image forming portions U, one for one, are sequentially transferred in layers onto the outward surface of the belt 8, in the corresponding primary transfer nips. As a result, an unfixed full-color toner image is synthetically effected on the belt 8 by the four monochromatic toner images, different in color, layered upon the belt 8. Then, the unfixed full-color toner image is conveyed to the secondary transfer nip.

Meanwhile, sheets S of recording paper stored in the first sheet feeder cassette 15 or the second sheet feeder cassette 16 are fed one by one into the main assembly of the image forming apparatus 1 by the operation of the recording medium feeding mechanism of the apparatus 1, and are sent to a pair of registration rollers 18 through a recording medium conveyance passage 17. The pair of registration rollers 18 catches each sheet S and temporarily holds the sheet S so that if the sheet S arrives askew, it is straightened. Then, the pair of registration rollers 18 conveys the sheet S to the secondary transfer nip with such timing that the sheet S synchronously arrives at the secondary transfer nip with the full-color toner image on the belt 8.

While the sheet S is conveyed through the secondary transfer nip, remaining sandwiched by the belt 8 and the secondary transfer roller 14, a preset secondary transfer bias is applied to the secondary transfer roller 14. Consequently, the four toner images (which effects a full-color toner image) on the belt 8 are transferred together (secondary transfer) onto the sheet S. As the sheet S comes out of the secondary transfer nip, it separates from the surface of the belt 8, and is introduced into a fixing apparatus 100, as an image heating apparatus, through a recording medium conveyance passage 19. While the sheet S and the toner images thereon are conveyed through the fixing apparatus 100, they are heated and pressed by the fixing apparatus 100. Consequently, the unfixed full-color toner image is fixed to the sheet S. After the sheet S comes out of the fixing apparatus 100, the sheet S is discharged, as a full-color print, into a delivery tray 21 by a pair discharge rollers 20.

(Fixing Apparatus)

The fixing apparatus 100 in this embodiment is an image heating apparatus of the so-called belt nip type, electromagnetic induction heating (IH) type, and oil-less fixation type.

By the way, regarding the positioning of the fixing apparatus 100, the front surface of the apparatus 100 is the one on the recording medium entrance side, and the rear surface of the apparatus 100 is the one on the sheet exit side. The left and right sides of the apparatus 100 are the left and right sides as seen from the front side of the apparatus 100. In this embodiment, the left side in the drawings is referred to as the front side, and the right side in the drawings is referred to as the rear side. The top and bottom sides are those with reference to the gravity direction. Further, the upstream or downstream side of the apparatus are those with reference to the direction V in which a sheet S of recording paper is conveyed (sheet conveyance direction V).

Further, regarding the positioning of the members of which the fixing apparatus 100 is made up, their lengthwise direction (length) or widthwise direction (width) is such a direction (or measurement) that is parallel to the direction that is perpendicular to the direction in which a sheet S of recording paper is conveyed in the recording paper conveyance passage of the fixing apparatus 100. The short dimension direction (or dimension in terms of short dimension direction) is the direction parallel to the direction V in which the sheet S is conveyed through the recording paper conveyance passage of the fixing apparatus 100.

Figure 3:
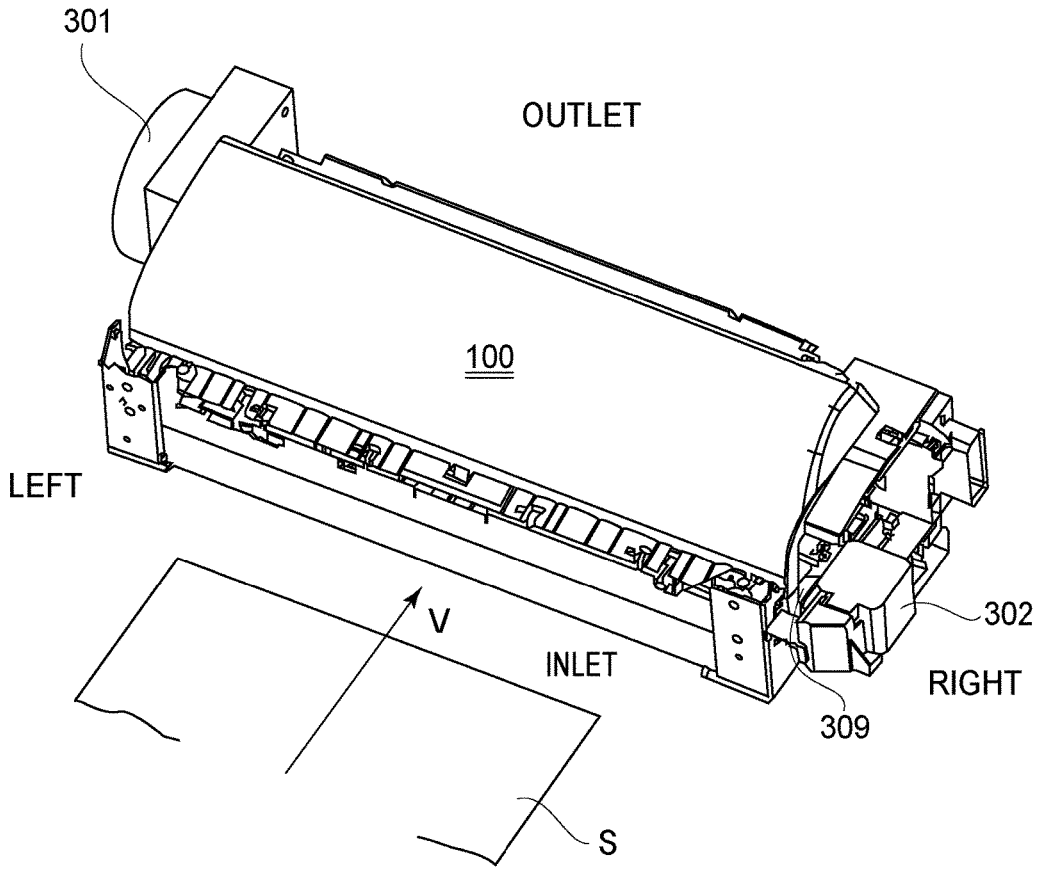
FIG. 3 is an external perspective view of the fixing apparatus in the first embodiment.
Figure 4:
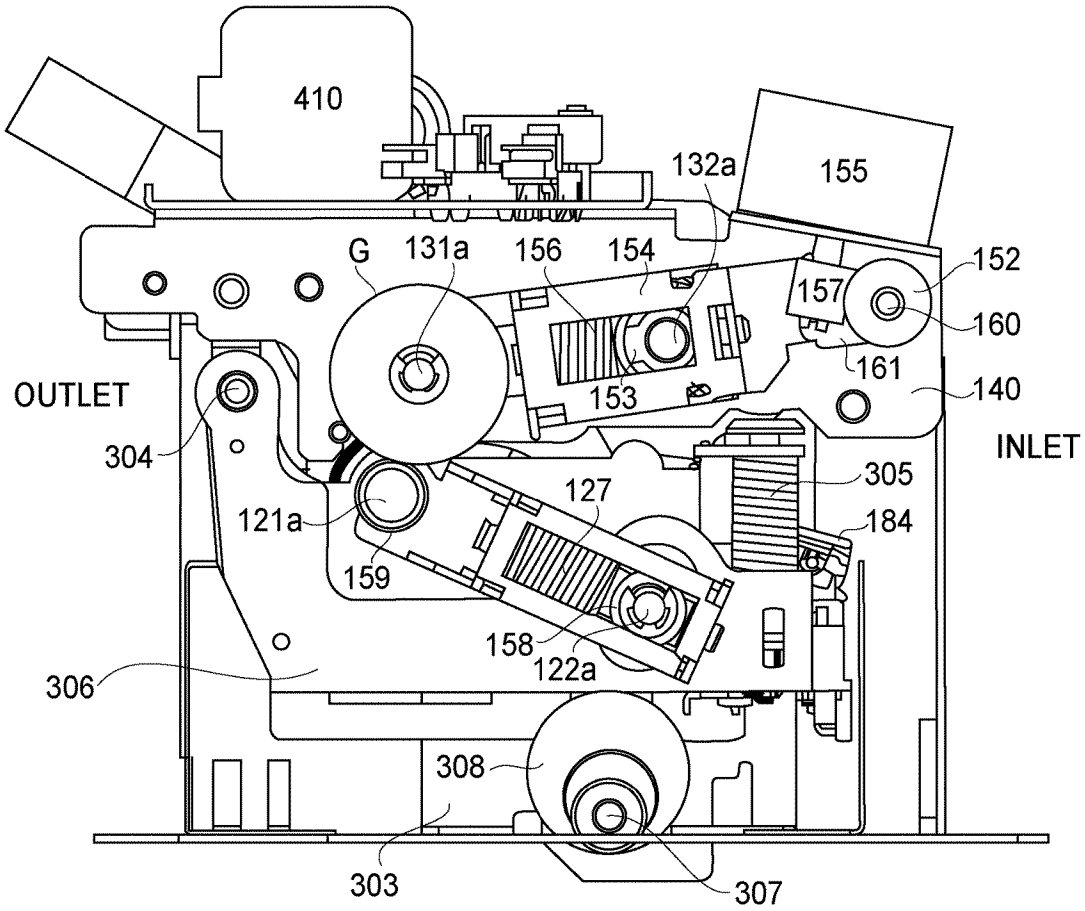
FIG. 4 is a schematic sectional view of the essential portion of the fixing apparatus shown in FIG. 3, as seen from the left side of the apparatus.
Figure 5:
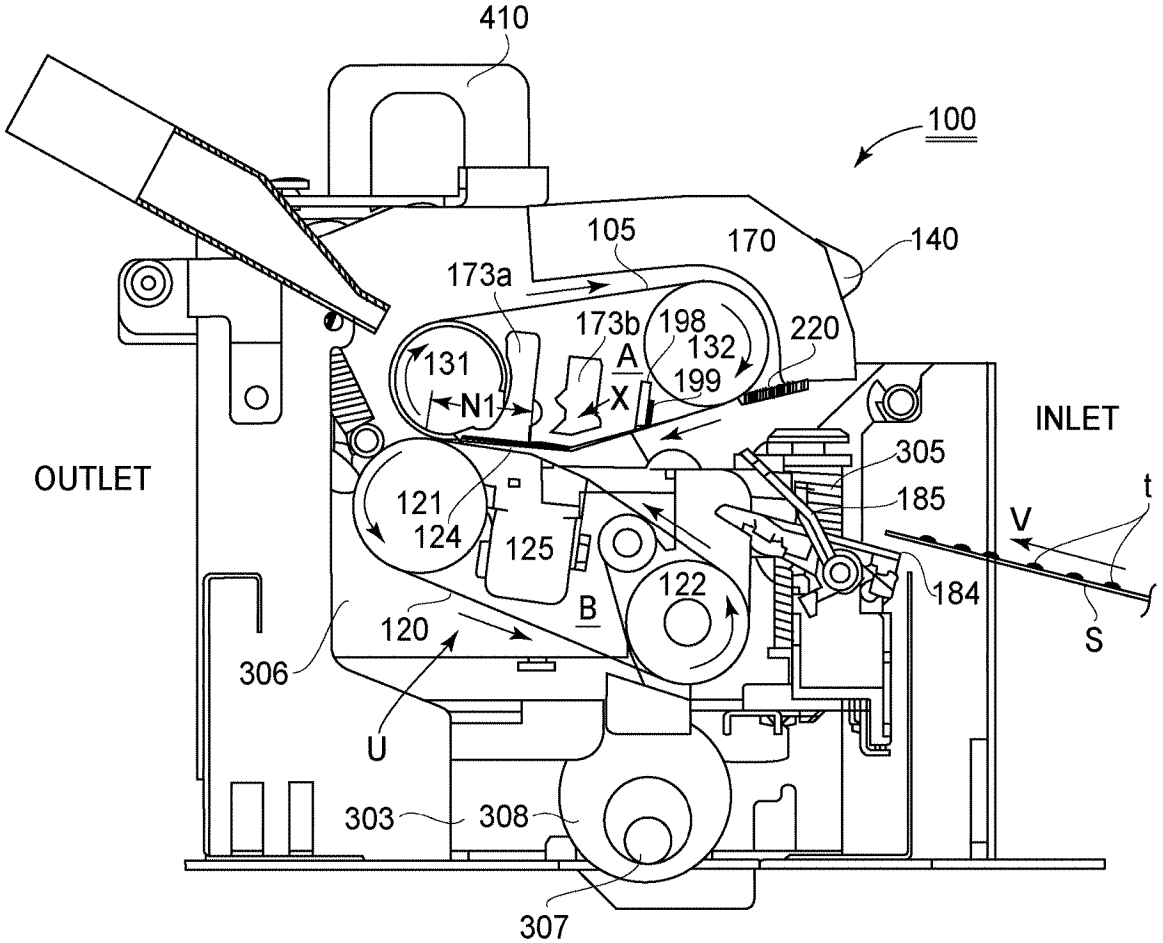
FIG. 5 is a cross-sectional view of the essential portion of the fixing apparatus in the first embodiment, as seen from the left side of the apparatus (1).
Figure 6:
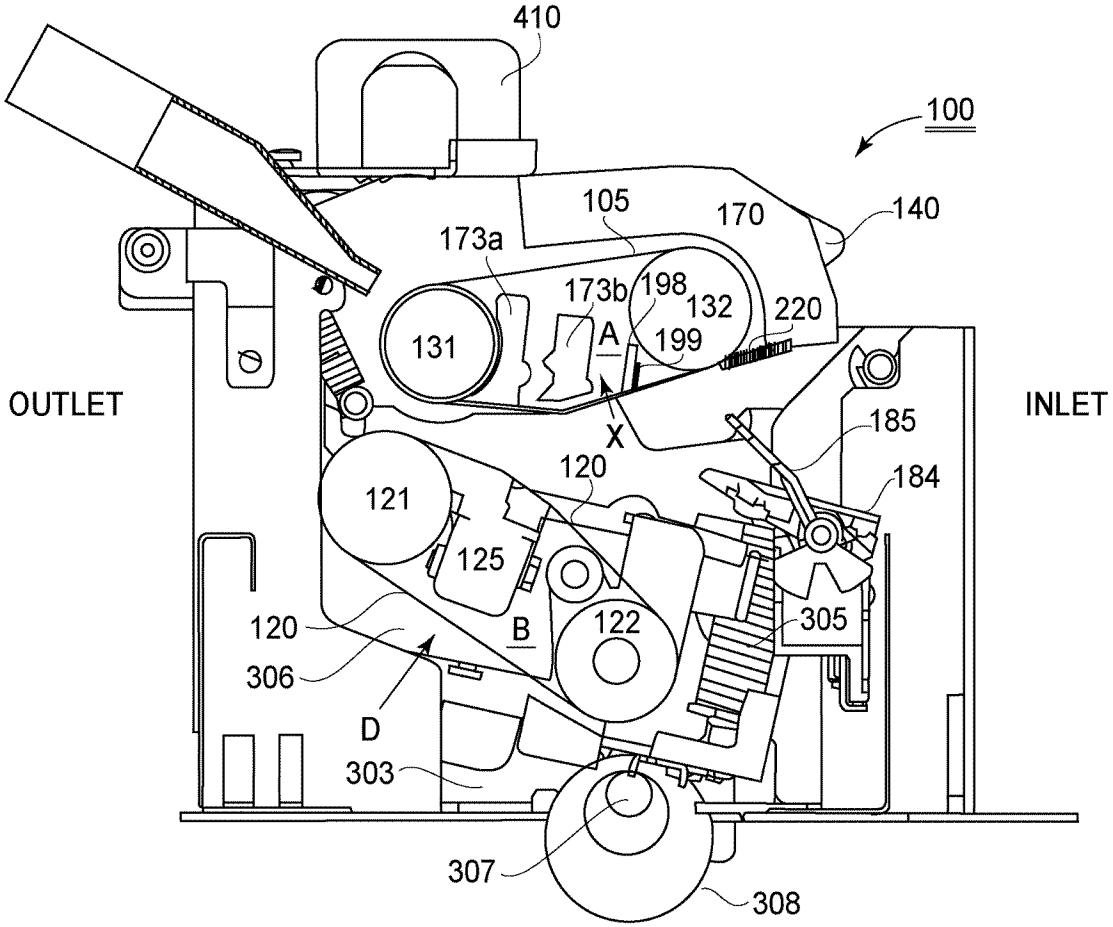
FIG. 6 also is a cross-sectional view of the essential portion of the fixing apparatus in the first embodiment, as seen from the left side of the apparatus (2).

FIG. 3 is an external perspective view of the fixing apparatus 100 in this embodiment. FIG. 4 is a schematic left side view of the essential portion of the apparatus 100, when the bottom belt assembly B is under a preset amount of pressure. FIG. 1 is a left side view of the essential portion of the apparatus 100, when the bottom belt assembly B is under the preset amount of pressure, and the movable pad 173*b* is in contact with the fixation pad 173*a*. FIG. 5 is a left side view of the essential portion of the apparatus 100, when the bottom belt assembly B is under the preset amount of pressure, and the movable pad 173*b* is not in contact with fixation pad 173*a*. FIG. 6 is a left side view of the essential portion of the apparatus 100, when the bottom belt assembly B is not in contact with the top belt assembly A.

Parts (a) and (b) of FIG. 7 are perspective views of the left and right pad moving mechanisms 180 (pad position switching mechanisms) of the top belt assembly A, respectively. FIG. 8 is an exploded perspective view of the top belt assembly A, and shows the fixation pad 173*a*, movable pad 173*b*, and friction reduction sheet 199 of the top belt assembly A. FIG. 9 is a left side view of the essential portion of the left pad moving mechanism 180, when the movable pad 173*b* is not in contact with the fixation pad 173*a*. FIGS. 10 and 11 are a left view of the essential portion of the left pad moving mechanism 180, when the movable pad 173*b* is in contact with the fixation pad 173*a*. FIG. 12 is a perspective view of the belt deviation controlling mechanism portion of the fixing apparatus 100.

The fixing apparatus 100 has the top belt assembly A, as a heating unit, the belt of which is driven by the corresponding motor 301 (FIG. 3), and a bottom belt assembly B as a pressure applying unit. It also has a mechanism (bottom belt assembly moving means) for causing the bottom belt assembly B to press on, or to separate from, the top belt assembly A.

Further, the fixing apparatus 100 has an induction heater (magnetic flux generating means), which is a heating means for heating the fixation belt 105 of the top belt assembly A. Moreover, it has the left and right switching mechanisms 180 (FIG. 7) for switching the movable pad 173*b* in position, and a mechanism (FIG. 12) for controlling the fixation belt 105 in lateral deviation. Next, the above-described members of the fixing apparatus 100 are described in the stated order.

1) Top Belt Assembly a and IH Heater 170

The top belt assembly A is disposed between the left and right top plates 140 of the frame of the fixing apparatus 100. This assembly A has the flexible fixation belt 105 (endless belt), as a rotational fixing member (fixing member: first rotational member), which has a release layer as its surface layer, and the peripheral surface of which faces the image bearing surface of a sheet S of recording paper. It also has multiple belt suspending members, more specifically, the driver roller 131 (support roller), a steering roller 132, which doubles as a tension roller, and a fixation pad 173*a* (first pad).

The driver roller 131 is disposed between the left and right top plates 140, and on the recording paper exit side of the top belt assembly A. The driver roller 131 is rotatably supported by the left and right top plates 140, by its left and right shaft portions 131*a* (FIG. 7), with the placement of a pair of bearings 154*a* (FIG. 12) between the left and right shafts 131*a* and left and right shafts 131*a*, one for one. On the outward side of the left and right top plates 140, a pair of steering roller support arms 154 (FIG. 4: a left one is not shown) are disposed so that they extend from the driver roller side toward the recording paper exit. The right supporting arm 154 (unshown) is solidly fixed to the right top plate 140.

Referring to FIG. 12, the left supporting arm 154 is supported by a left shaft 131*a* of the driver roller 131, with the placement of a bearing 154*a* between the arm 154 and left shaft 131*a*, being thereby enabled to pivot upward or downward about the shaft 131*a*. The free end of the left supporting arm 154 is provided with a pin 151. Further, the top left plate 140 is provided with a shaft 160, which is on the outwardly facing surface of the plate 140, and on the recording paper entrance side.

Further, the top belt assembly A is provided with a U-shaped plate 161 (having groove 161*a*), and a worm wheel 152 (helical gear) solidly attached to the U-shaped plate 161. The worm wheel 152 is rotatably supported by the abovementioned shaft 160. Further, the pin 151 of the left supporting arm 154 is in engagement with the U-shaped plate 162. The top plate 140 is provided with a stepping motor 155. The worm wheel 152 is in mesh with the worm gear solidly attached to the rotational axle of this stepping motor 155.

As the stepping motor 155 is driven forward or in reverse, the U-shaped plate 161 is pivoted upward or downward by the combination of the worm gear and worm wheel 152. Thus, the left supporting arm 154 is made to pivot upward or downward by the upward or downward pivoting of the U-shaped plate 161.

In terms of the left-right direction of the fixing apparatus 100, the steering roller 132 is disposed between the top left and top right plates 14. In terms of the recording paper conveyance direction V, the steering roller 132 is disposed in the recording paper entrance side of the fixing apparatus 100. The left and right shaft portions 132*a* (FIG. 7) are rotatably supported by the left and right supporting arms 154, with the placement of a pair of bearings 153 (FIG. 2) between the shafts 153 and supporting arms 154, respectively. The bearing 153 is supported by the supporting arm 154 so that not only can it be slid in the belt tension direction, but also, it remains under the pressure generated by a tension spring 154 in the direction to push the bearing away from the driver roller 131.

Referring to FIGS. 1, 7, and 8, the fixation pad 173*a* is formed of stainless steel (SUS), for example. It is disposed within the aforementioned fixation belt loop. It is disposed between the driver roller 131 and steering roller 132, with its belt contacting surface facing downward. It is disposed closer to the driver roller 131 than to the steering roller 132. More concretely, the fixation pad 173*a* is fixed to the left and right pad supporting members 181, respectively. The left and right end portions of the fixation pad 173*a* are solidly fixed to the pad supporting portions 181*a* of the left and right pad supporting members 181, respectively. The left and right pad supporting members 181 are supported by the top left and top right plates 140 by being solidly attached thereto.

The movable pad 173*b* (second pad) is formed of stainless steel (SUS), for example. It is disposed on the inward side of the fixation belt loop. It is disposed between the driver roller 131 and steering roller 132. It is disposed closer to the driver roller 131 than to the steering roller 132, with the belt contacting surface facing downward. It is movable in the direction to separate from the fixation pad 173*a* or the direction to come into contact with the fixation pad 173*a*.

More concretely, the fixation pad 173*a* is supported by the left and right pad supporting members 181. The movable pad 173*b* is supported between the left and right pad supporting members 181. The left and right slider portions 173*b*-1 (end portions) of the fixation pad 173*a* are fitted in the grooves 181*b* with which the left and right pad supporting members 181 are provided. The grooves 181*b* extend roughly in the front-rear direction. The movable pad 173*b* is allowed to move in the direction to separate from the fixation pad 173*a*, or in the direction to come into contact with the fixation pad 173*a*.

That is, the movable pad 173*b* is disposed on the inward side of the fixation belt loop. In terms of the recording paper conveyance direction V, the movable pad 173*b* is disposed on the upstream side of the fixation pad 173*a*, and is allowed to move in the direction to move away from the fixation pad 173*a*, and the direction to come closer to the fixation pad 173*a*.

Referring to FIGS. 1 and 8, the low friction sheet 199 is for reducing the friction between the inward surface of the fixation belt 105 and the fixation pad 173*a*. It is made up of a polyimide film coated with fluorine resin. It is lower in friction than the inward surface of the fixation belt 105 (also, surface of pad 173*a* and surface of pad 173*b*.

In terms of the lengthwise direction of the fixing apparatus 100, the low friction sheet 199 is greater in dimension than the fixation belt 105 (which is 380 mm in this embodiment). It is 390 mm in length, and 70 μm in thickness. The upstream end of the low friction sheet 199 in terms of the belt conveyance direction is between the movable pad 173*b* and steering roller 132, and is fixed to the plate 198, the left and right ends of which are solidly attached to the top left and top right plates 140, respectively.

It is disposed so that it extends from the plate 193 to the downstream end of the fixation pad 173*a* in terms of the belt conveyance direction, by way of the pressure applying portion of the movable pad 173*b*. It is between the inward surface of the fixation belt 105 and fixation pad 173*a*, and between the fixation belt 105 and movable pad 173*b*. The presence of the low friction sheet 199 reduces the amount of torque necessary to drive the driver roller 131, making it possible to reliably rotate the fixation belt 105.

That is, the low friction sheet 199 is such a sheet-like member that covers the fixation pad 173*a* (first pad) and movable pad 173*b* (second pad), which are disposed so that the fixation belt 105 (endless belt) slides on them as it is circularly driven.

FIG. 19 is a schematic sectional view of one of comparative combinations of fixation pad 173*a*, movable pad 173*b*, low friction sheet 199*a*, and low friction sheet 199*b*.

Referring to part (a) of FIG. 19, in a case when the movable pad 173*b* is disposed close to the fixation pad 173*a*, if the low friction sheet 199*a* for the movable pad 173*b* is so long that it extends beyond the pressure application surface of the movable pad 173*b* in terms of the belt conveyance direction (by excessive portion 199*b*-1), it is possible that the excessive portion 199*b*-1 will be dragged into the area between the pressure application surface of the fixation pad 173*a* and fixation belt 105. If the excessive portion 199*b*-1 is dragged into the area between the pressure application surface of the fixation pad 173*a* and fixation belt 105, the area increases in the friction between the low friction sheet 199*b* and fixation belt 105, which, in turn, may result in such a problems that the low friction sheet 199*b* breaks, and also, that the low friction sheet 199*a* breaks as well.

Referring to part (b) of FIG. 19, if the low friction sheet 199*b* disposed for the movable pad 173*b* is not long enough to reach the downstream end of the pressure application surface of the movable pad 173*b* in terms of the belt conveyance direction, the downstream end portion 173*b*-3 of the pressure application surface is not covered by the low friction sheet 199, possibly causing such a problem that the downstream edge of the movable pad 173*b* will come into contact with the inward surface of the fixation belt 105, and increase the friction between the fixation belt 105 and movable pad 173*b*.

Referring to FIGS. 1 and 8, in comparison, in this embodiment, both the pressure application surface (on which fixation belt 105 slides) of the movable pad 173*b* and the pressure application surface (on which fixation belt 105 slides) of the fixation pad 173*a* are covered by a single low friction sheet, that is, the low friction sheet 199. Therefore, it is possible to prevent the problem that the fixation belt 105 is significantly reduced in durability by the friction between the fixation belt 105 and fixation pad 173*a*, and the friction between the fixation belt 105 and movable pad 173*b*.

The fixation belt 105, which is suspended and tensioned by the combination of the driver roller 131, steering roller 132, fixation pad 173*a*, and movable pad 173*b* in such a manner that the fixation belt 105 bridges the adjacent two belt suspending members, is provided with a preset amount of tension. More concretely, the tension is provided by a tension spring 156 that generates such a force that presses the steering roller 132 in the direction to move away from the driver roller 131. In this embodiment, the fixation belt 105 is provided with 200 N of tension. Thus, the bottom side of the fixation belt 105, in terms of the belt loop, remains pressing against the downwardly facing surface (belt contacting surface, surface on which the belt slides) of the fixation pad 173*a*, by its inward surface, with the presence of the low friction sheet 199 between itself and fixation pad 173*a*.

The material for the fixation belt 105 is optional. That is, any material is acceptable as long as it can be heated by the IH heater 170, and is heat resistant. For example, the fixation belt 105 may be an endless belt comprising a magnetic metallic layer that is made of nickel, stainless steel, or the like, and is 75 μm in thickness, 380 mm in width, and 200 mm in length in terms of circumferential direction, a silicone rubber layer, which is coated on the peripheral surface of the metallic layer and is 300 μm in thickness, and a piece of PFA tube, as a surface layer (release layer), fitted on the silicon rubber layer.

The driver roller 131 is made up of a solid stainless rod, as a metallic core, which is 18 mm in diameter, and an elastic layer molded of silicon rubber in manner to cover the entirety of the peripheral surface of the solid stainless rod. It is disposed on the recording paper exit side of the fixation nip N formed by fixation belt 105 and a pressure belt 120, as the second rotational member, which will be described later. Its elastic layer is elastically deformed by a present amount, by the pressure applied thereto by a pressure roller 121 which will be described later.

In this embodiment, the nip formed between the fixation belt 105 and pressure belt 120 by the combination of the driver roller 131 and pressure roller 121 is roughly flat. However, it is not mandatory that the nip is roughly flat. For example, in order to prevent a sheet S of recording paper from being buckled in the nip due to the difference in speed between the pressure belt 120 and fixation belt 105 in the nip, the fixing apparatus 100 may be intentionally designed in terms of their shape. For example, they may be shaped so that they inversely crown.

The steering roller 132 is a hollow roller formed of stainless steel, for example. It is 20 mm in external diameter, and 18 mm in internal diameter. It functions as a tension roller that provides the fixation belt 105 with a preset amount of tension while suspending the fixation belt 105. It works also as a steering roller by being controlled in angle by a belt deviation control mechanism (which will be described later) for controlling the snaking of the fixation belt 105 in the direction perpendicular to the fixation belt movement direction.

The driver roller 131 is provided with a driving force input gear G (FIG. 4). The left end of the shaft 131*a* of the driver roller 131 is coaxially fitted with the driving force input gear G. To this gear G, a driving force is inputted from a driving motor 301 (FIG. 3) by way of a driving force transmitting means (unshown), whereby the driver roller 131 is rotationally driven at a preset speed in the clockwise direction indicated by an arrow in FIG. 1. By the rotation of this driver roller 131, the fixation belt 105 is circularly conveyed in the clockwise direction indicated by another arrow mark in FIG. 1, at a speed that corresponds to the peripheral surface of the driver roller 131. The steering roller 132 is rotated by the circular movement of the belt 105.

The fixation belt 105 circularly moves in such a manner that the inward surface of the portion of the belt 105, which corresponds in position to the bottom half of the belt loop, slides on the upwardly facing surface of the low friction sheet 199, which is in contact with the downwardly facing surface (belt backing surface) of the fixation pad 173*a*. Thus, it is ensured that the driving force is transmitted to the driver roller 131 to ensure that a sheet S of recording paper is reliably conveyed through the fixation nip N, which will be described later.

The IH heater 170 is a means for heating the fixation belt 105. It is an inductive heating coil unit made up of an excitation coil, a magnetic core, a holder by which the excitation coil and magnetic core are held, etc. In terms of the vertical direction, it is disposed on the top side of the top belt assembly A, with the presence of a preset amount of gap between itself, and the top portion, in terms of the belt loop, of the fixation belt 105 (portion of belt 105, between driver roller 131 and steering roller 132).

The excitation coil of the IH heater 170 is supplied with AC current by the heater controller 170C, which is under the control of the CPU 10, through the heater driver 170D (FIG. 14). Thus, the excitation coil generates alternating magnetic flux, which is guided to the magnetic core, and induces an eddy current in the magnetic metallic layer of the fixation belt 105, which is inductively heatable. This eddy current generates heat (Joule's heat), the amount of which is related to the specific resistivity of the inductively heatable substance.

Thus, the fixation belt 105 is quickly heated by electromagnetic induction, while the surface temperature of the fixation belt 105 is detected by the thermistor 220 (temperature sensor). Then, the information regarding the temperature detected by the thermistor 220 is fed back to the CUP 10. The CPU 10 controls (temperature control) the amount by which electrical power is supplied to the excitation coil of the IH heater 170 so that the temperature detected by the thermistor 220 and inputted into the CPU 10 from the thermistor 220 remains at a preset target level.

(2) Pad Moving Mechanism 180

Referring to FIGS. 7 and 8 to 11, a pad moving mechanism 180, which is a switching mechanism for switching the fixation pad 173*a* in position, is described.

The fixation pad 173*a* of the top belt assembly A is such a pad that remains in contact with the inward surface of the fixation belt 105, and causes the fixation belt 105 to form the first nip N1 (FIG. 5), which has a preset width in terms of the recording paper conveyance direction V, between the fixation belt 105 and the pressure belt 120, which opposes the belt 105. The movable pad 173*b* is such a pad that is disposed on the inward side of the belt loop, and is disposed on the upstream side of the fixation pad 173*a* in terms of the recording paper conveyance direction V.

The pad moving mechanism 180 is such a mechanism that changes the movable pad 173*b* in position relative to the fixation pad 173*a*. More concretely, the pad moving mechanism 180 is capable of executing the first operation, which is for placing the movable pad 173*b* in the first position, which is away from the fixation pad 173*a* by a preset distance. Further, it is capable of executing the second operation, which is for placing the movable pad 173*b* in the preset second position, which is adjacent to the fixation pad 173*a*, so that a combination of the fixation pad 173*a* and movable pad 173*b* forms a nip N2 (FIG. 1), which has the second width, which is wider than the abovementioned first width.

That is, the first operation is such an operation that is to be carried out by the pad moving mechanism 180 to move the movable pad 173*b* (second pad) into the first position so that only the fixation pad 173*a* (first pad) contacts the fixation belt 105. The second operation is such an operation that is to be carried out by the pad moving mechanism 180 to move the movable pad 173*b* into the second position in which the combination of the fixation pad 173*a* and movable pad 173*b* contact the fixation belt 105.

In this embodiment, the fixing apparatus 100 is provided with a pair of pad moving mechanisms 180 disposed on the left and right ends, one for one, of the fixing apparatus 100 for changing the movable pad 173*b* in position as shown in parts (a) and (b) of FIG. 7. The left and right pad moving mechanism 180 are the same in configuration, and are symmetrically disposed. Thus, both mechanisms 180 are described together, with reference to primarily the left pad moving mechanism 180.

Each pad moving mechanism 180 is made up of the movable pad 173*b*, a pad supporting member 181, a pad moving cam 182, a pad pressing spring 183, a drive train 184, etc. The movable pad 173*b* is changed in position by the pad moving mechanism 180 according to the basis weight of a sheet S of recording paper to be conveyed through the fixing apparatus 100 for image fixation. That is, the CPU 10 controls the pad moving mechanism 180 so that the pad moving mechanism 180 carries out the aforementioned first or second operation according to the basis weight of a sheet S of recording paper, which is to be introduced into the fixing apparatus 100 (image forming apparatus 1).

More concretely, the CPU 10 controls the pad moving mechanism 180 so that, when the basis weight of a sheet S of recording paper to be conveyed through the fixing apparatus 100 for image fixation is no more than a preset value, the pad moving mechanism 180 carries out the second operation, whereas when the basis weight is no more than a preset value, the pad moving mechanism 180 carries out the first operation.

In this embodiment, when a sheet S of recording paper to be introduced into the fixing apparatus 100 for image fixation is no more than 151 gsm in basis weight, the movable pad 173*b* is placed in the noncontact position X (first position) as shown in FIGS. 5 and 9, whereas when it is not less than 151 gsm, the movable pad 173*b* is placed in the contact position Y (second position) shown in FIGS. 1, 10, and 11.

Initially (normally), the movable pad 173*b* is kept in the noncontact position X, and the home position for the movable pad 173*b* is the noncontact position, as shown in FIG. 9. Thus, when a sheet S of recording paper to be introduced into the fixing apparatus 100 for image fixation is no more than 151 gsm in basis weight, the fixing process is carried out while the movable pad 173*b* is kept in the noncontact position X or its home position.

When a sheet S of recording medium to be introduced into the fixing apparatus 100 for image fixation is no less than 151 gsm in basis weight, the fixation process is carried out after the movable pad 173*b* is moved from the noncontact position X, or the home position, to the contact position Y shown in FIGS. 1, 10, and 11.

When the fixing process is carried out on a sheet S of recording paper, which is no less than 151 gsm in basis weight, the CPU 10 rotates the motor 401 a preset number of full turns in the clockwise direction. Thus, the pad moving cam 182 is rotated by the driving force transmitted thereto through the drive train 184. Thus, the movable pad 173*b* is moved toward the fixation pad 173*a* by the pressure generated by the pair of pad pressing springs disposed between the left and right springs seats 173*b*-2 and the left and right spring seats 181*c* of the pad supporting member 181, respectively. That is, the movable pad 173*b* slides toward the fixation pad 173*a*, in the groove 181*b* with which the pad supporting member 181 is provided.

Thus, the left and right ends 173*c* (bumping portions) of the movable pad 173*b* come into contact with, and are caught by, the left and right left and right movable pad catching portions 173*a*-2, respectively, of the fixation pad 173*a*, being thereby fixed in position (FIGS. 10 and 11). After the placement of the movable pad 173*b* in this position (second position), the gap W between the upstream end of the fixation pad 173*a* and the downstream end of the movable pad 173*b*, in terms of the recording paper conveyance direction V, is 0.2 mm, which is not large enough to cause image defects. That is, the movable pad 173*b* is moved from its noncontact position X to its contact position Y, and is held in the contact position Y.

As soon as the job to carry out the fixing process on sheets S of recording paper, which are no less than 151 gsm in basis weight ends, the CPU 10 rotates the motor 401 in the counter clockwise direction by a preset number of full-turns. Thus, the pad moving cam 182 is rotated in reverse by the force transmitted thereto from the motor driver gear 401 by way of the drive train 184. Therefore, movable pad 173*b* is made to move away from the fixation pad 173*a*, following the groove 181*b* of the pad supporting member 181, while compressing the pad pressing springs 183. That is, the movable pad 173*b* is made to return from its contact position Y to the noncontact position X, or its home position, and is held therein.

(3) Bottom Belt Assembly B, and Mechanism for Pressing or Releasing Bottom Belt Assembly B Referring to FIG. 1, the bottom belt assembly B is disposed on the bottom side of the top belt assembly A. It is attached to the bottom frame 306 (pressing frame), which is supported by a hinge shaft 304 (FIG. 4) so that it is allowed to pivot upward or downward about the hinge shaft 304. The hinge shaft 304 is on the recording paper exit side of the fixing apparatus 100, and is solidly attached to the bottom left and bottom right plates 303 of the fixing apparatus 100.

This assembly B has a rotational fixing member 120 (pressing member: second rotational member), which forms the first nip N1 (FIG. 5), or second nip N2 (FIG. 1) between itself and the fixation belt 105. In this embodiment, this rotational fixing member 120 is a flexible pressure belt (endless belt). The assembly B has a combination of a pressure roller 121, a tension roller 122, and a pressure pad 125, by which the pressure belt 120 is suspended and tensioned.

Referring to FIG. 4, the pressure roller 121 is rotatably supported by the left and right plates of the bottom frame 306. The left and right portion of the shaft 121*a* of the pressure roller 121 are rotatably supported by the left and right plate of the bottom frame 306, with the placement of a pair of bearings 159 between the shaft 121*a* and the left and right plates. The tension roller 122 is rotatably supported by the left and right plate of the bottom frame 306. The left and right end portions of the shaft 122*a* of the tension roller 122 are rotatably supported by the left and right plate of the bottom frame 306, with the placement of a pair of bearings 158 between the shaft 122*a* and the left and right plates. Each bearing 158 is supported by the bottom frame 306 in such a manner that it is allowed to slide along the bottom frame 306 in the direction to increase or to decrease the pressure belt tension. Further, it is kept under the pressure generated by the tension spring 127 in the direction to pull it away from the pressure roller 121.

By the way, the abovementioned right shafts 121*a*, right bearings 159 and 122*a*, right bearing 158, and right tension spring 127 of the fixing apparatus 100 are not shown in FIG. 4. However, they are the same in structure as the left counterparts of the fixing apparatus 100, and are symmetrically disposed relative to the counterparts, respectively.

Returning to FIG. 1, the pressure pad 125 is a member formed of silicon rubber, for example. It is supported by the bottom frame 306 by being solidly attached to the left and right plates of the bottom frame 306, by its left and right end portions, respectively. The outwardly facing surface, with reference to the belt loop, which the pressure belt 120 forms, is covered with a low friction sheet 124 for minimizing the friction between the inward surface of the pressure belt 120 and the pressure pad 125. The low friction sheet 124 is a sheet of polyimide film coated with fluorine resin, and its surface is substantially smaller in friction than the inward surface of the pressure belt 120.

The pressure roller 121 is disposed so that it is between the left and right plates of the bottom frame 306, and on the recording paper exit side of the fixing apparatus 100. As for the tension roller 122, it is disposed so that it is also between the left and right plates of the bottom frame 306, but on the recording paper entrance side. The pressure pad 125 is on the inward side of the pressure belt loop (120). It is stationarily supported between the pressure roller 121 and tension roller 122, being positioned closer to the pressure roller 121, with its belt-pressing surface facing upward.

The pressure belt 120 is suspended by a combination of the pressure roller 121, tension roller 122, and pressure pad 125. It is provided with a preset amount of tension. More concretely, the pressure belt 120 is provided with the preset amount of tension by the pressure generated by the aforementioned left and right tension springs 127 of the fixing apparatus 100, in the direction to move the tension roller 122 in the direction to provide the pressure belt 120 with tension. In this embodiment, the pressure belt 120 is provided with 200 N of tension. Here, the inward surface of the top portion, with reference to the belt loop, of the pressure belt 120 is in contact with the upwardly facing surface of the pressure pad 125.

The choice of the pressure belt 120 is optional. All that is required of the pressure belt 120 is to be heat resistant. For example, it may be an endless belt comprising a metallic layer that is formed of nickel and is 50 μm in thickness, 380 mm in, and 200 mm in circumferential length, a silicon rubber layer that is coated on the outward surface of the metallic layer, and is 300 μm in thickness, and a piece of PFA tube placed as the surface layer (release layer) over the silicon layer. The pressure roller 121 is a piece of solid stainless rod that is 20 mm in external diameter. The tension roller 122 is a hollow roller. For example, it is a piece of hollow stainless cylinder. It is roughly 20 mm in external diameter, and 18 mm in internal diameter.

Here, the bottom belt assembly B can be pivoted upward or downward about the hinge shaft 304 (FIG. 4) by a mechanism for pressing or releasing the bottom belt assembly B, as a means for pressing the bottom belt assembly B upon the top belt assembly A, or separating the bottom belt assembly B from the top belt assembly A. That is, as the bottom belt assembly B is upwardly pivoted by the pressing-releasing mechanism, not only is it moved into its pressure application position U as shown in FIG. 1 or 5, whereas as it is downwardly pivoted, it moves back to its noncontact position D (no-pressure position) as shown in FIG. 6. Further, the bottom belt assembly B forms the fixation nip between itself and the top belt assembly A, by being moved into the pressure application position U (FIGS. 1 and 2).

What occurs when the movable pad 173*b* of the top belt assembly A is in the noncontact position X as shown in FIG. 9 is as follows: The pressure roller 121 and pressure pad 125 press on the driver roller 131 and fixation pad 173*a*, respectively, of the top belt assembly A, with the presence of the pressure belt 120 and fixation belt 105 between the pressure roller 121 and driver roller 131, and between the pressure pad 125 and fixation pad 173*a*, so that a preset amount of pressure is generated between the two belts 120 and 105.

Thus, the fixation nip N1, which has the preset first width, in terms of the recording paper conveyance direction V, is formed between the fixation belt 105 of the top belt assembly A, and the pressure belt 120 of the bottom belt assembly B (FIG. 5). In this embodiment, the width of the fixation nip N1 is roughly 20 mm.

On the other hand, what occurs when the movable pad 173*b* of the top belt assembly A is in the contact position Y as shown in FIGS. 10 and 11 is as follows: The pressure roller 121 presses on the driver roller 131 of the top belt assembly A, and the pressure pad 125 presses on a combination of the fixation pad 173*b* and movable pad 173*b* of the top belt assembly A, with the presence of the pressure belt 120 and fixation belt 105 between the pressure roller 121 and driver roller 131, and between the pressure pad 125 and the combination of the fixation pad 173*a* and movable pad 173*b*, so that a preset amount of pressure is generated between the two belts 120 and 105.

Thus, the fixation nip N2, which has the preset second width, in terms of the recording paper conveyance direction V, which is greater by a preset amount than the first width of the above-described fixation nip N1 (FIG. 5), is formed between the fixation belt 105 of the top belt assembly A, and the pressure belt 120 of the bottom belt assembly B (FIG. 1). In this embodiment, the width of the fixation nip N2 is roughly 45 mm.

Further, as the bottom belt assembly B is moved from its pressure application position U to its noncontact position D, it separates from the top belt assembly A, stopping thereby applying pressure to the top belt assembly A (nip elimination: FIG. 6).

In this embodiment, the top belt assembly A is provided with the movable pad 173*b* as described above. Further, the fixing apparatus 100 is configured so that the a sheet S of recording paper is conveyed into the fixation nip by the pressure belt 120. Therefore, if it is the bottom belt assembly B that is provided with a movable pad (173*b*), it is possible that the presence of the movable pad will affect the attitude in which the sheet S is introduced into the fixation nip. This is why it is the top belt assembly A that is provided with the movable pad 173*b*. In a case when there is no chance that the attitude in which the sheet S is conveyed into the fixing apparatus 100 is affected by the presence of a movable pad, there is no problem even if it is the bottom belt assembly B that is provided with the movable pad.

At this time, the above-mentioned mechanism for pressing the bottom belt assembly B upon the top belt assembly A, or separating the bottom belt assembly B from the top belt assembly A is described. Referring to FIG. 4, the bottom frame 306 is provided with a pressure application spring unit having a pair of compression springs 305 for elastically pressing the bottom belt assembly B upon the top belt assembly A. The compression spring unit is on the opposite side of the bottom frame 306 from the hinge shaft 304.

The mechanism is also provided with a pressure application cam shaft 307, which is between the bottom portions of the left and right plates 303, and is rotatably supported by a pair of bearings. The left and right ends of the pressure application cam shaft 307 are provided with a pair of eccentric pressure application cams 308, which are identical in shape and are symmetrically and solidly attached to the cam shaft 307. The right end of the pressure application cam shaft 307 is fitted with a pressure application gear 309 (FIG. 3), which is coaxially and solidly attached to the cam shaft 307. Into this gear 309, a driving force is inputted from a pressure application motor 302 by way of a driving force transmitting means (unshown), to rotationally drive the pressure application cam shaft 307.

The pressure application cam shaft 307 can be rotated into the first angular position, in which its largest radius portion faces upward as shown in Referring to FIGS. 4, 1, and 5, and the second angular position, in which the largest radius portion faces downward.

As the pressure application cam shaft 307 is rotated into the first angular position, the bottom frame 306, by which the bottom belt assembly B is held, is lifted by the larges radius portion of the eccentric pressure application cam 308. Thus, the bottom belt assembly B is placed in contact with the top belt assembly A, and presses on the top belt assembly A, while compressing the compression springs 305 of the compression spring unit. Consequently, the bottom belt assembly B is elastically pressed upon the top belt assembly A by a preset amount of pressure (400 N, for example) generated by the resiliency of the compression springs 305, and is held in the pressure application position U shown in FIGS. 1 and 5.

Here, as the driver roller 131 is pressed by the pressure roller 121, the driver roller 131 deforms roughly several hundreds of micrometers in the opposite direction from the pressure roller 121. This deformation of the driver roller 131 is one of the main reasons why the center portion of the fixation nip N1 (FIG. 5), and the center portion of the fixation nip N2 (FIG. 1), in terms of their lengthwise direction, are slightly lower in pressure than their lengthwise end portions. In this embodiment, therefore, in order to prevent this pressure loss, the driver roller 131, or both the driver roller 131 and pressure roller 121, are shaped so that they slightly crown in sectional view, so that the nip formed by the driver roller 131 and pressure roller 121 is roughly flat (straight in cross section). In this embodiment, the driver roller 131 is shaped so that it positively crowns in sectional view by 300 μm.

Further, as the pressure application cam shaft 307 is rotated into the second angular position, and kept therein, the largest radius portion of the eccentric pressure application cam 308 faces downward, whereas the smallest radius portion of the eccentric pressure application 308 faces the bottom surface of the bottom frame 306. Thus, the bottom belt assembly B is allowed to pivot downward. That is, the bottom belt assembly B stops pressing on the top belt assembly A, and is held in the noncontact position D, shown in FIG. 6, in which it remains separated from the top belt assembly A by a preset distance.

At this time, referring to FIG. 13, which is a flowchart of the control sequence, and FIG. 14, which is a block diagram of the control system, the control sequence for causing the bottom belt assembly B to pivot upward or downward is described. Normally, the bottom belt assembly B is held in the noncontact position D shown in FIG. 6. In response to the pressure application start command from the CPU 10 <S9-001>, the pressure application motor 302 rotates a preset number (N) of full-turns in the clockwise direction <S9-002> by being driven by the motor driver 302D. Thus, the pressure application cam shaft 307 is rotated half a full-turn.

Consequently, the eccentric cam 308 is changed in attitude from the second angular position shown in FIG. 6 to the first angular position shown in FIG. 5. Thus, the bottom belt assembly B is made to upwardly pivot into the pressure application position U<S9-003>.

That is, the pressure roller 121 and pressure pad 125 are made to press on the driver roller 131 and fixation pad 173*a*, respectively, of the top belt assembly A, with a preset amount of pressure, with the pressure belt 120 and fixation belt 105 being sandwiched between the driver roller 131 and pressure roller 121, and between the pressure pad 125, and the combination of the fixation pad 173*a* and movable pad 173*b*, as shown in FIG. 1, or the pressure roller 121 presses on the driver roller 131, and the pressure pad 125 presses on the fixation pad 173*a*, by a preset amount of pressure, with the pressure belt 120 and fixation belt 105 being sandwiched between the pressure roller 121 and driver roller 131, and between the pressure pad 125 and fixation pad 173*a*, as shown in FIG. 5.

Consequently, the fixation nip N2 (FIG. 1) having the preset width in terms of the recording paper conveyance direction V, or the fixation nip N1 (FIG. 5) having the preset width, is formed between the fixation belt 105 and pressure belt 120 <S9-004>.

On the other hand, as the CPU 10 issues a separation command while the bottom belt assembly B is held in one of the pressure application positions shown in FIGS. 1 and 5<S9-005>, the pressure application motor 302 rotates a preset number (N) of full-turns in the counterclockwise direction <S9-006> by being driven by the motor driver 302D. Thus, the pressure application cam shaft 307 is rotated half a full-turn. Consequently, the eccentric cam 308 is changed in attitude from the first angular position shown in FIGS. 1 and 5 to the second angular position shown in FIG. 6.

Thus, the bottom belt assembly B is made to downwardly pivot into the noncontact position D<S9-007>. Consequently, the fixation nip N1 or the fixation nip N2 is eliminated <S9-008>.

(4) Fixing Operation and Temperature Control

Next, referring to FIG. 14, which is a block diagram of the control system, and FIG. 15, which is a flowchart of the control sequence, the fixing operation of the fixing apparatus 100 is described. While the fixing apparatus 100 is kept on standby, the movable pad 173*b* of the top belt assembly A is held in its noncontact position X shown in FIG. 6, and the bottom belt assembly B is held in the noncontact position D shown in FIG. 6. Further, the motor 301 is kept turned off, and the IH heat 170 is not supplied with electric power.

The CPU 10 begins a preset image formation sequence, in response to the inputting of a printing job start signal. First, it determines which operation is to be carried out by the fixing apparatus 100 according to the basis weight of sheets S of recording paper to be used for the job <S10-001>.

If the recording paper to be used is no more than 151 gsm in basis weight, the CPU 10 determines whether or not the movable pad 173*b* is in the noncontact position X shown in FIG. 9, based on the signal from the movable pad position detecting means. If it determines that the movable pad 173*b* is in the noncontact position X, the CPU 10 rotates the movable pad cam 182 half a full rotation with the use of the pad driving motor 410. That is, it moves the movable pad 173*b* from the noncontact position X shown in FIG. 9, to the contact position Y shown in FIGS. 10 and 11<S10-002>. If it determines that the movable pad 173*b* is not in the noncontact position X, it does not drive the pad moving motor 410, keeping thereby the movable pad 173*b* in the contact position Y.

On the other hand, if it determines that the recording paper to be used is no more than 151 gsm in basis weight, the CPU 10 determines whether or not the movable pad 173*b* is in the noncontact position X shown in FIG. 9, based on the movable pad position detecting means. If it determines that the movable pad 173*b* is in the noncontact position X, it does not drive the pad driving motor 410, keeping thereby the movable pad 173*b* on standby in the noncontact position X. If it determines that the movable pad 173*b* is not in the noncontact position X, it rotates the movable pad cam 183 half a full turn, by driving the pad driving motor 410 with the use of the motor driver 410D. That is, it moves the movable pad 173*b* from the contact position Y shown in FIGS. 10 and 11, to the noncontact position X shown in FIG. 9.

Then, the CPU 10 moves the bottom belt assembly B from the noncontact position D shown in FIG. 6 to the pressure application position U shown in FIGS. 1 and 5, by rotating the pressure application cam shaft 307 half a turn by driving the pressure application motor 302 with the use of the motor driver 302D.

Thus, when a sheet S of recording paper used for the job is no less than 151 gsm in basis weight, that is, when the movable pad 173*b* is in the contact position Y, the fixation nip N2 is formed between the fixation belt 105 and pressure belt 120 as shown in FIG. 1 <S10-003>.

On the other hand, when the sheet S of recording paper used for the job is no more than 151 gsm in basis weight, that is, when the movable pad 173*b* is in the noncontact position X, the fixation nip N1 is formed between the fixation belt 105 and pressure belt 120 as shown in FIG. 5<S10-003>.

Next, the CPU 10 inputs a driving force into the driving force input gear G (FIG. 4) by driving the motor 301 with the use of the motor driver 301D. Thus, the driver roller 131 of the top belt assembly A is driven as described above, whereby the rotation of the fixation belt 105 is started.

The rotational force from the driving force input gear G is transmitted also to the pressure roller 121 of the bottom belt assembly B by way of the drive gear train (unshown), whereby the pressure belt 120 is rotationally driven in the counterclockwise direction indicated by an arrow mark in FIG. 1. As the pressure roller 121 begins to be rotated, the pressure belt 120 begins to be rotated by the friction between the pressure belt 120 and the rotating fixation belt 105, in the counterclockwise direction indicated by the arrow mark in FIG. 1<S10-004>. The direction in which the fixation belt 105 moves in the fixation nips N2 (FIG. 1) and N1 (FIG. 5), and the direction in which the pressure belt 120 moves in the fixation nips N2 (FIG. 1) and N1 (FIG. 5), are the same. Further, the fixation belt 105 and pressure belt 120 are roughly the same in their speed in the fixation nips N2 and N1.

Next, the CPU 10 begins to supply the IH heater 170 with electrical power with the use of the heater controller 170C and heater driver 170D, in order to heat the fixation belt 105 by electromagnetic induction to raise the temperature of the fixation belt 105 to a preset target level and keep it at the level while the fixation belt 105 is rotating. That is, the CPU 10 begins the temperature control sequence for raising the temperature of the fixation belt 105 to one hundred forty degrees to two hundred degrees according to the basis weight and type of a sheet S of recording paper to be used for the job, and to keep the temperature of the fixation belt 105 at the target level <S10-005>.

This is how the first fixation nip N1 (FIG. 5), or the second fixation nip N2 (FIG. 1), is formed, and while the fixation belt 105 and pressure belt 120 are rotated, the temperature of the fixation belt 105 is increased to the target level and kept at the target level. Then, a sheet S of recording paper bearing an unfixed toner image t on one of its primary surfaces is introduced into the fixing apparatus 100 from the image forming portion.

The sheet S enters the first fixation nip N1, or the second fixation nip N2, which is the area of contact between the fixation belt 105 and the pressure belt 120, while being guided by an entrance guide 184 disposed at the sheet entrance side of the fixing apparatus 100. The entrance guide 184 is provided with a flag sensor 185 having a photo-interrupter. It detects the timing with which the sheet S moves through the fixing apparatus 100.

The sheet S is conveyed through the first fixation nip N1 or the second fixation nip N2, remaining sandwiched between the fixation belt 105 and the pressure belt 120 in such an attitude that its image bearing surface and opposite surface face the fixation belt 105 and pressure belt 120, respectively. Thus, the unfixed toner image t is fixed, as a permanent image, to the surface of the sheet S by the heat from the fixation belt 105 and the nip pressure. After being conveyed through the fixation nip N2 or nip N1, the sheet S separates from the surface of the fixation belt 105, comes out of the fixing apparatus 100 from the recording paper exit side, is conveyed further, and is discharged into a delivery tray 21 by a pair of discharge rollers 20 (FIG. 2).

Then, as soon as the conveyance of the sheet S of recording paper in the printing job for yielding a single print, or continuously yielding multiple prints, ends, the CPU 10 stops heating the fixation belt 105, controlling the fixation belt 105 in temperature, and supplying the IH heater 170 with electrical power <S10-006>. Then, it stops the rotation of the fixation belt 105 and pressure belt 120 by turning off the electrical power supply to the motor 301 <S10-007>.

Then, it moves the bottom belt assembly B from its press application position U (contact position) shown in FIG. 1 or FIG. 5, to the noncontact position D shown in FIG. 6, by rotating the pressure application cam 307 half a turn by driving the pressure application motor 302 with the use of the motor driver 302D. Thus, the fixation nips N2 or N1 between the fixation belt 105 and the pressure belt 120 is eliminated <S10-008>. Further, if the movable pad 173*b* is in the contact position Y shown in FIGS. 10 and 11, the CPU 10 moves the movable pad 173*b* to the noncontact position X shown in FIG. 9, by rotating the pad driving motor 410 half a turn with the use of the motor driver 410D <S10-009>.

Then, the CPU 10 waits for the inputting of the next printing job start signal.

At this time, referring to FIG. 14, which is a block diagram of the control system, and FIG. 16, which is a flowchart of the control sequence, the temperature control of the fixation belt 105 is described. The top belt assembly A is provided with a thermistor 220, as a temperature detecting member, for detecting the surface temperature of the fixation belt 105. The CPU 10 begins to supply the IH heater 170 with electrical power, with the use of the heater controller 170*c* and heater driver 170D, with a preset control timing, in response to the inputting of a printing job start signal <S11-001>. The fixation belt 105 increases in temperature as it is heated by the IH heater, which is based on electromagnetic induction.

The temperature of the fixation belt 105 is detected by the thermistor 220. The information regarding the detected temperature level (electrical information regarding temperature) is inputted into the CPU 10. As the temperature level detected by the thermistor 220 exceeds a preset value (target level), the CPU 10 stops supplying the IH heater 170 with electrical power. Then, if the temperature level detected by the thermistor 220 becomes lower than the preset value <S11-004>, the CPU 10 restarts supplying the IH heater 170 with electrical power <S11-001>.

With the repetition of the above-described steps <S11-001>-<S11-004>, the temperature of the fixation belt 105 is maintained at the target level. The above-described control of the temperature of the fixation belt 105 is continued until the printing job for yielding a single print, or continuously yielding multiple prints, is completed <S11-005>.

(5) Mechanism for Controlling Lateral Belt Deviation

As the fixation belt 105 is rotationally driven, a phenomenon that the fixation belt 105 deviates in the widthwise direction of the belt 105, that is, the direction perpendicular to the recording paper conveyance direction V, occurs. As the phenomenon occurs, the pressure belt 120, which forms the first fixation nip N1 (FIG. 5) or the second fixation nip N2 (FIG. 1) by being pressed on the fixation belt 105, also laterally deviates with the fixation belt 105.

In this embodiment, this lateral deviation of the fixation belt 105 is controlled with the use of the belt deviation controlling method of the so-called swing type to keep the fixation belt 105 in a preset range in terms of the widthwise direction. The belt deviation controlling method of the swing type is such a controlling method that if it is detected that the fixation belt 105 has laterally deviated by no less than a preset amount with reference to the center of the fixing apparatus 100 in terms of the direction perpendicular to the recording paper conveyance direction V, the steering roller 132 is tilted in the opposite direction from the direction in which the fixation belt 105 has deviated.

With the repetition of this belt deviation controlling method of the swing type, the fixation belt 105 periodically swings within the preset widthwise range. Thus, the lateral deviation of the fixation belt 105 can be reliably controlled by this method. That is, the fixing apparatus 100 is configured so that the fixation belt 105 is allowed to move back and forth in the direction that is perpendicular to the recording sheet S conveyance direction V.

The fixing apparatus 100 is provided with a sensing portion (unshown) for detecting the edge of the fixation belt 105. The sensing portion is located on the left side (front side) of the fixation belt 105 of the top belt assembly A, near the steering roller 132. The CPU 10 detects the position (lateral belt deviation position) of the edge of the fixation belt 105 with the use of this sensing portion. Then, it rotates the stepping motor 155 in the positive direction (clockwise direction) by a preset number of times, according to the detected edge position of the fixation belt 105.

Thus, the left steering roller supporting arm 154 is made to pivot upward or downward by a preset amount of control amount about the shaft 131*a*, by the above-described mechanisms 157, 152, 161 and 151, causing the steering roller 132 to change in angle. Consequently, the fixation belt 105 is controlled in lateral deviation.

Modifications

In the foregoing, the present invention was described with reference to one of the preferred embodiments of the present invention. However, the preceding embodiment is not intended to limit the present invention in scope. That is, the present invention is also applicable to various image heating apparatuses (fixing apparatuses) of the known type, which are different in configuration from the one in the preceding embodiment.

Modification 1

In the above-described embodiment, the fixing apparatus 100 was configured so that, when the second fixation nip N2 (FIG. 1) is formed, the movable pad 173*b* contacts the catching portion 173*a*-2 of the fixation pad 173*a*, by its contacting portion 173*c* (FIG. 11).

However, this configuration is not intended to limit the present invention in scope. That is, the present invention is also applicable to an image heating apparatus (fixing apparatus) configured so that the gap W between the two pads reduces as one of the surface of the movable pad 173*b* simply comes into contact with one of the surfaces of the fixation pad 173*a*, as shown by the schematic drawing in part (a) of FIG. 17.

In this case, an elastic member 181*d* may be disposed between the fixation pad 173*a* and movable pad 173*b*, as shown in part (c) of FIG. 17, to reduce the gap W between the two pads 173*a* and 173*b* to no more than 0.2 mm.

Part (b) of FIG. 17 is a schematic drawing of the modified version of the fixing apparatus 100 in the first embodiment, in which the movable pad 173*b* is in the noncontact position X, and there is the fixation nip N1 between the fixation belt 105 and pressure belt 120.

Further, referring to part (a) of FIG. 18, the present invention is also applicable to an image heating apparatus (fixing apparatus) configured so that an elastic member 181*e* is placed between the movable pad 173*b* and pressure pad 125 to reduce the gap W between the fixation pad 173*a* and movable pad 173*b* to no more than 0.2 mm.

Further, referring to part (b) of FIG. 18, the present invention is also applicable to an image heating apparatus (fixing apparatus) configured so that an elastic member 181*d* is provided between the fixation pad 173*a* and movable pad 173*b*, and an elastic member 181*e* is provided between the fixation pad 173*a* and movable pad 173*b* to reduce the gap W between the two pads to no more than 0.2 mm.

Modification 2

In the fixing apparatus 100 in the first embodiment, the movable pad 173*b* (second pad) was placed on the inward side of the belt 105. Further, in terms of the recording paper conveyance direction V, it was disposed on the upstream side of the fixation pad 173*a* (first pad). However, the first embodiment is not intended to limit the present invention is scope in terms of the positioning of the movable pad 173*b*. That is, the present invention is also applicable to an image heating apparatus (fixing apparatus) configured so that the movable pad 173*b* is disposed on the downstream side of the fixation pad 173*a* in terms of the recording paper conveyance direction V, instead.

Modification 3

In the above-described first embodiment, the heating system was based on electromagnetic induction. However, the embodiment is not intended to limit the present invention in terms of the method for heating the fixation belt 105. That is, the present invention is also applicable to an image heating apparatus (fixing apparatus) that employs other heating system than the one in the preceding embodiment. For example, the present invention is also applicable to an image heating apparatus (fixing apparatus) which employs a halogen heater, for example, to heat the fixation belt 105. More concretely, the present invention is also applicable to an image heating apparatus (fixing apparatus) configured so that a heating system such as a halogen heater is disposed in the hollow of the driver roller 131 or pressure roller 121.

Modification 4

In the fixing apparatus 100 in the preceding embodiment, the pair of rotational members 105 and 120 for forming the first fixation nip N1 or second fixation nip N2, were both endless belts. However, the embodiment is not intended to limit the present invention in scope in terms of the choice of the rotational members. For example, the present invention is also applicable to an image heating apparatus (fixing apparatus) configured so that one of the pair of rotational members 105 and 120 is an endless belt, and the other is a roller. That is, the present invention is applicable to an image heating apparatus (fixing apparatus) configured so that at least one of the pair of rotational members 105 and 120 is an endless belt.

Modification 5

Further, in the above-described embodiment, the image heating apparatus was a fixing apparatus for fixing an unfixed toner image t to a sheet S of recording paper. However, the embodiment is not intended to limit the present invention in scope in terms of the type of an image heating apparatus. For example, the present invention is also applicable to an image heating apparatus (which also is referred to as fixing apparatus) for heating and pressing a toner image that has been temporarily fixed to a sheet S of recording paper, in order to improve the toner image in gloss.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

an endless belt and a rotatable member configured to form a nip for heating a toner image on a recording material therebetween;

a substantially stationary pad member and a movable pad member provided along a feeding direction of the recording material and configured to press said endless belt toward said rotatable member from an inside of said endless belt;

a moving mechanism configured to move said movable pad member between a first position at which said movable pad member presses said endless belt toward said rotatable member and a second position at which said movable pad member does not press said endless belt toward said rotatable member;

a single sheet-like member configured to cover such a surface of said stationary pad member as is opposite to said rotatable member and such a surface of said movable pad member as is opposite to said rotatable member; and a controller configured to control an operation of said moving mechanism based on a kind of the recording material, wherein, when the recording material has first basis weight, said controller controls said moving mechanism so that said movable pad member is in the first position, and, when the recording material has a second basis weight that is less that the first basis weigh, said controller controls said moving mechanism so that said movable pad member is in the second position.

2. An apparatus according to claim 1, wherein such a portion of said single sheet-like member as covers said stationary pad member and said movable pad member is slidable relative to an inner surface of said endless belt when said movable pad member is in the first position.

3. An apparatus according to claim 1, wherein such a portion of which said single sheet-like member as covers said stationary pad member is slidable relative to an inner surface of said endless belt when said movable pad member is in the second position.

4. An image heating apparatus comprising:

an endless belt and a rotatable member configured to form a nip for heating a toner image on a recording material therebetween;

a substantially stationary pad member and a movable pad member provided along a feeding direction of the recording material and configured to press said endless belt toward said rotatable member from an inside of said endless belt;

a moving mechanism configured to move said movable pad member between a first position at which said movable pad member presses said endless belt toward said rotatable member and a second position at which said movable pad member does not press said endless belt toward said rotatable member; and a single sheet-like member configured to cover such a surface of said stationary pad member as is opposite to said rotatable member and such a surface of said movable pad member as is opposite to said rotatable member, wherein said movable pad member is provided with an abutting portion configured to abut said stationary pad member when said movable pad member is in the first position.

5. An apparatus according to claim 4, wherein said abutting portion comprises rubber.

6. An apparatus according to claim 1, wherein said stationary pad member is substantially stationary while an image heating operation is executable.

7. An image heating apparatus comprising:

an endless belt and a rotatable member configured to form a nip for heating a toner image on a recording material therebetween;

a substantially stationary pad member and a movable pad member provided along a feeding direction of the recording material and configured to press said endless belt toward said rotatable member from an inside of said endless belt;

a moving mechanism configured to move said movable pad member between a first position at which said movable pad member presses said endless belt toward said rotatable member and a second position at which said movable pad member does not press said endless belt toward said rotatable member; and a single sheet-like member configured to cover such a surface of said stationary pad member as is opposite to said rotatable member and such a surface of said movable pad member as is opposite to said rotatable member, wherein said movable pad member is disposed upstream of said stationary pad member with respect to the feeding direction of the recording material.

8. An image heating apparatus comprising:

an endless belt and a rotatable member configured to form a nip for heating a toner image on a recording material therebetween;

a substantially stationary pad member and a movable pad member provided along a feeding direction of the recording material and configured to press said endless belt toward said rotatable member from an inside of said endless belt;

a moving mechanism configured to move said movable pad member between a first position at which said movable pad member presses said endless belt toward said rotatable member and a second position at which said movable pad member does not press said endless belt toward said rotatable member;

a single sheet-like member configured to cover such a surface of said stationary pad member as is opposite to said rotatable member and such a surface of said movable pad member as is opposite to said rotatable member; and a roller provided inside of said endless belt and configured to rotatably support said endless belt.

9. An apparatus according to claim 4, wherein such a portion of said single sheet-like member as covers said stationary pad member and said movable pad member is slidable relative to an inner surface of said endless belt when said movable pad member is in the first position.

10. An apparatus according to claim 4, wherein such a portion of which said single sheet-like member as covers said stationary pad member is slidable relative to an inner surface of said endless belt when said movable pad member is in the second position.

11. An apparatus according to claim 4, wherein said stationary pad member is substantially stationary while an image heating operation is executable.

12. An apparatus according to claim 7, wherein such a portion of said single sheet-like member as covers said stationary pad member and said movable pad member is slidable relative to an inner surface of said endless belt when said movable pad member is in the first position.

13. An apparatus according to claim 7, wherein such a portion of which said single sheet-like member as covers said stationary pad member is slidable relative to an inner surface of said endless belt when said movable pad member is in the second position.

14. An apparatus according to claim 7, wherein said stationary pad member is substantially stationary while an image heating operation is executable.

15. An apparatus according to claim 8, wherein such a portion of said single sheet-like member as covers said stationary pad member and said movable pad member is slidable relative to an inner surface of said endless belt when said movable pad member is in the first position.

16. An apparatus according to claim 8, wherein such a portion of which said single sheet-like member as covers said stationary pad member is slidable relative to an inner surface of said endless belt when said movable pad member is in the second position.

17. An apparatus according to claim 8, wherein said stationary pad member is substantially stationary while an image heating operation is executable.

* * * * *